United States Patent [19]

Wilke et al.

[11] 4,093,223

[45] June 6, 1978

[54] ELECTRONIC GAME APPARATUS AND METHOD

[76] Inventors: William F. Wilke, 702 N. Minnesota St., Carson City, Nev. 89701; Alan G. Hutcheson, 349 Smithridge, Reno, Nev. 89502; Richard D. Ross, 285 E. Lincoln Way, Sparks, Nev. 89431

[21] Appl. No.: 651,914

[22] Filed: Jan. 23, 1976

[51] Int. Cl.[2] ..... A63F 9/00

[52] U.S. Cl. ..... 273/94 R; 273/85 R; 273/DIG. 28

[58] Field of Search ..... 273/1 E, 85 R, 94, 54 C, 273/118 A, 119 A, 121 A, 122 A, 125 A, 126 A, 138 A, DIG. 28; 235/1 B, 92 GA, 156; 340/172.5, 323 R, 323 B, 337

[56] References Cited

U.S. PATENT DOCUMENTS

| | | | |
|---|---|---|---|
| 2,614,840 | 10/1952 | Monkres | 273/121 A |
| 3,231,276 | 1/1966 | Cooper | 273/94 |
| 3,556,525 | 1/1971 | Pegg | 273/94 |
| 3,868,112 | 2/1975 | Avera | 273/94 |
| 3,874,669 | 4/1975 | Ariano | 273/85 R |
| 3,907,290 | 9/1975 | Fisher et al. | 273/54 C |
| 4,026,555 | 5/1977 | Kirschner et al. | 273/85 R |

OTHER PUBLICATIONS

Electronics; "Scamp Microprocessor Aims to Replace Mechanical Logic"; Sep. 18, 1975; pp. 81–87.

Decus Proceedings; "Spacewar: Real-Time Capability of PDP-1"; 1962, pp. 37–38.

Popular Electronics; "The First Motorola/AMI '6800' MPU Computer Project"; Nov. 1975; pp. 33–37.

*Primary Examiner*—Richard C. Pinkham
*Assistant Examiner*—Vance Y. Hum
*Attorney, Agent, or Firm*—Phillips, Moore, Weissenberger, Lempio & Majestic

[57] ABSTRACT

An electronic apparatus for simulating athletic contests is disclosed. A specific embodiment of the apparatus is a football game including a simulated playing field, wherein the play execution and play outcome for each play is displayed in real time. Two opposing players are alternatively on defense or offense, according to standard football rules. The game is automatic except for the choosing of the play by the offensive player and the choosing of a counteracting play strategy by the defensive player. Random numbers are generated automatically by the apparatus, and are applied to probability tables to determine play results. A scoreboard keeps track automatically of the time left in the game, the score, the yards to go for a first down, etc. All aspects of the game are controlled by a microprocessor and a processor controller comprising a control program stored in a read-only memory. The playing field comprises an array of lights that are selectively turned on by the microprocessor to graphically show the play action.

24 Claims, 15 Drawing Figures

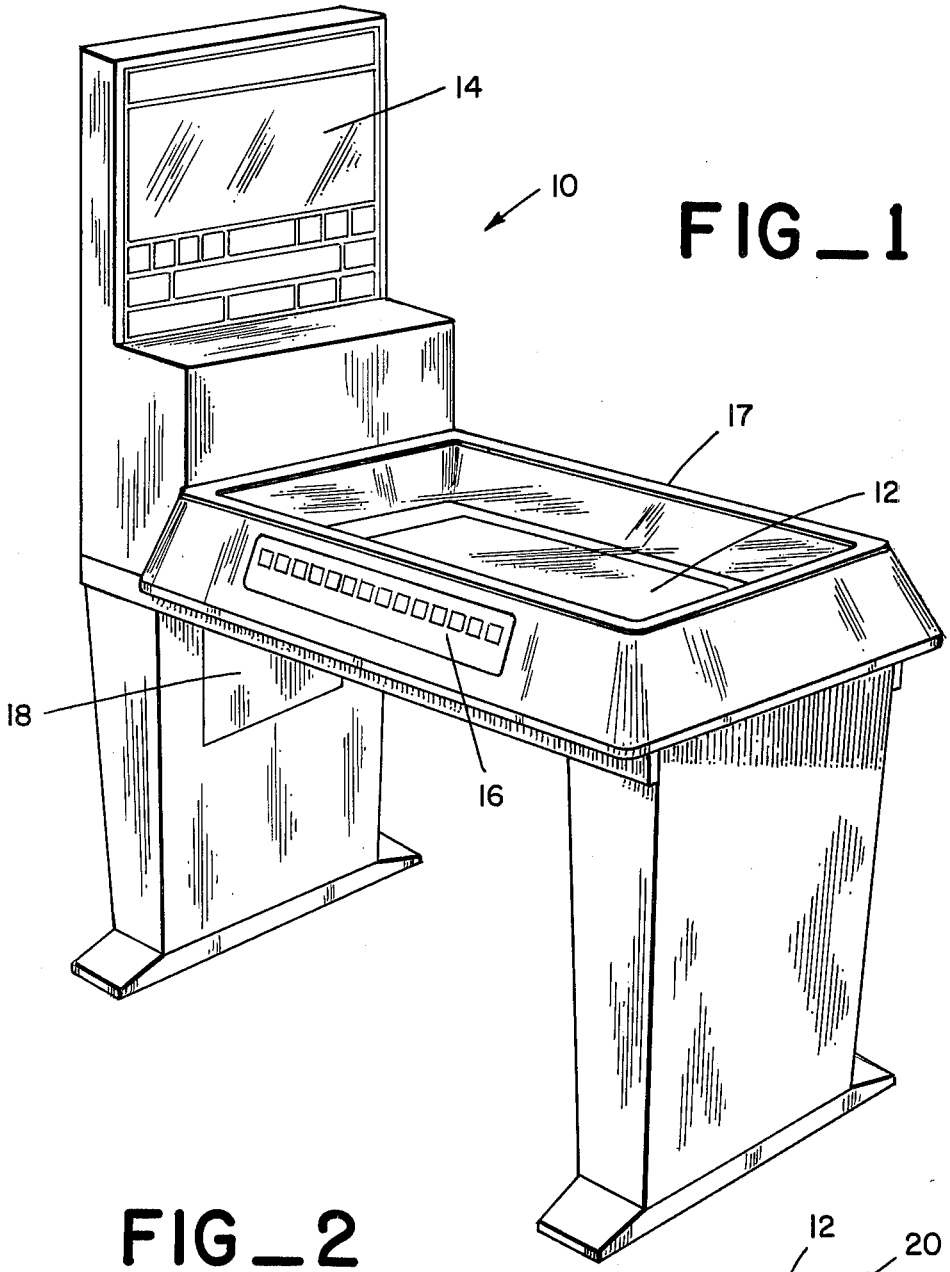
FIG_1
FIG_2
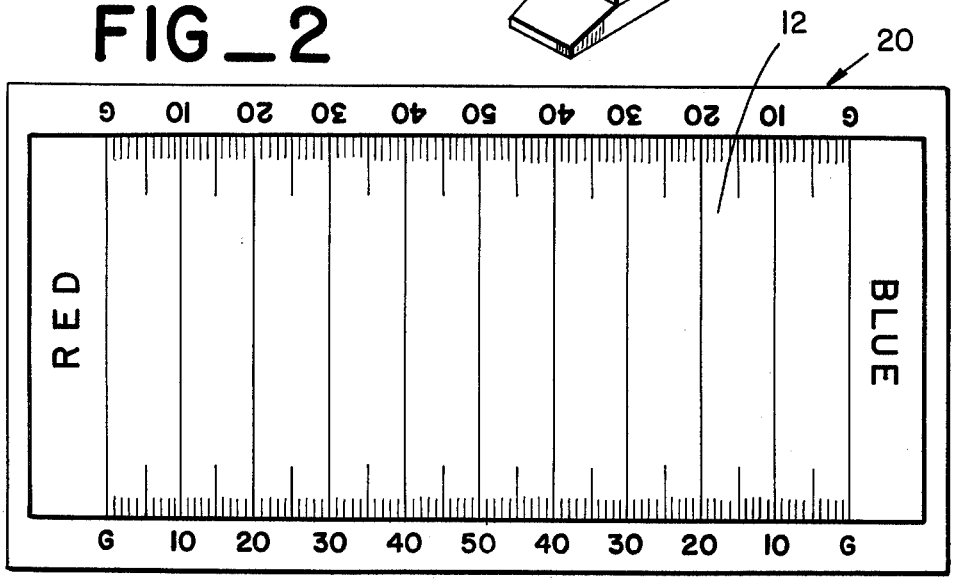

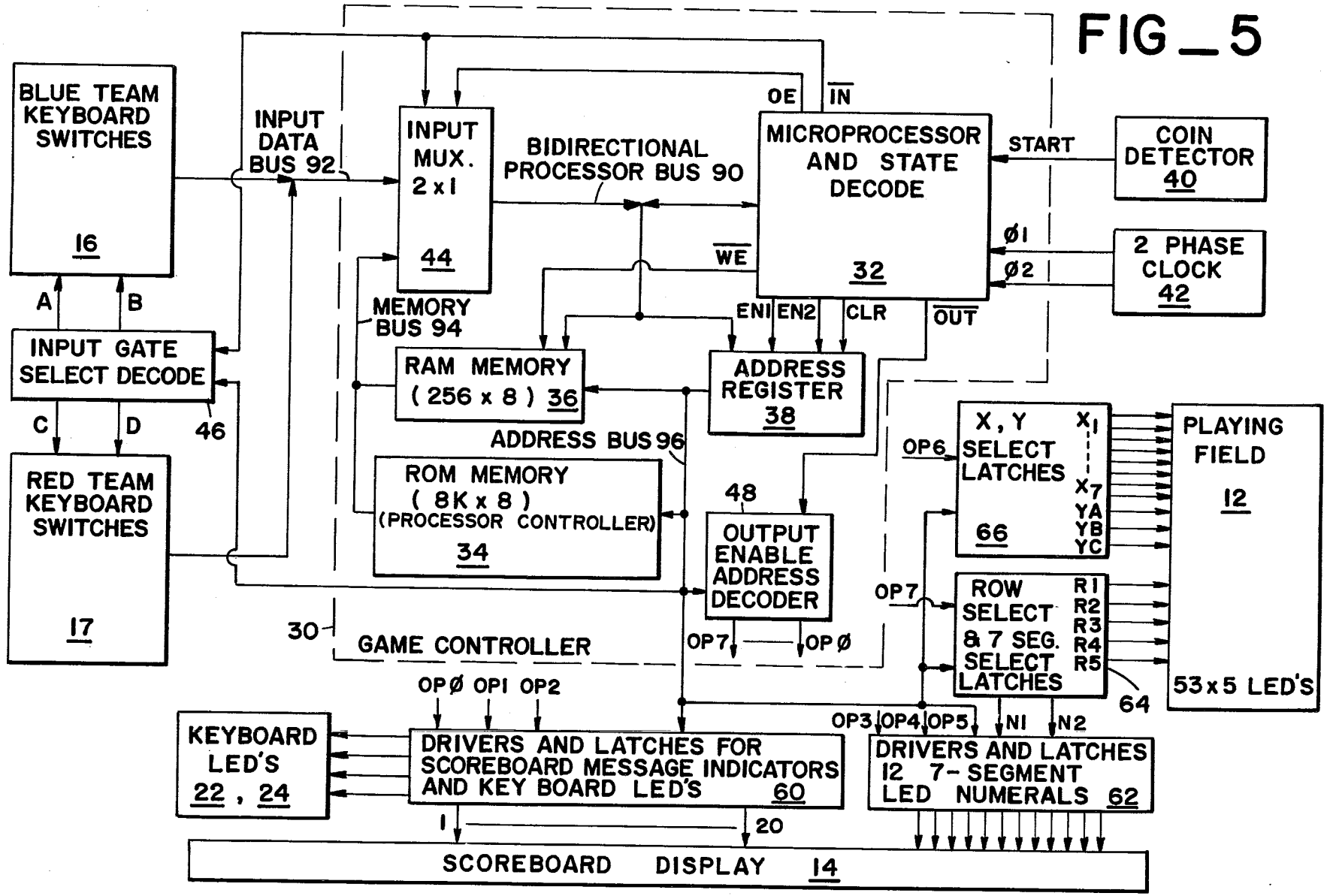
FIG_5
COIN DETECTOR 40
2 PHASE CLOCK 42
PLAYING FIELD 12
53 x 5 LED'S
START
Ø1
Ø2
MICROPROCESSOR AND STATE DECODE 32
OUT
CLR
IN
OE
EN1
EN2
WE
X, Y SELECT LATCHES 66
X1
X7
YA
YB
YC
OP6
ROW SELECT & 7 SEG. SELECT LATCHES
R1
R2
R3
R4
R5
64
N1
N2
OP7
OP3
OP4
OP5
DRIVERS AND LATCHES 12 7-SEGMENT LED NUMERALS 62
ADDRESS REGISTER 38
OUTPUT ENABLE ADDRESS DECODER
48
OP Ø
OP7
BIDIRECTIONAL PROCESSOR BUS 90
ADDRESS BUS 96
RAM MEMORY (256 x 8) 36
ROM MEMORY (8K x 8) (PROCESSOR CONTROLLER) 34
INPUT MUX. 2 x 1 44
MEMORY BUS 94
GAME CONTROLLER
OP Ø OP1 OP2
DRIVERS AND LATCHES FOR SCOREBOARD MESSAGE INDICATORS AND KEY BOARD LED'S 60
20
1
SCOREBOARD DISPLAY 14
30
INPUT DATA BUS 92
KEYBOARD LED'S 22, 24
BLUE TEAM KEYBOARD SWITCHES 16
A
B
INPUT GATE SELECT DECODE
46
C
D
RED TEAM KEYBOARD SWITCHES 17

* NOTE: THIS TABLE IS DIFFERENT FOR EACH OF THE THREE SUCCESS CRITERION.

** NOTE: EACH PLAY CHOICE HAS ITS OWN X VARIABLE ACCESSED PROBABILITY TABLE FOR DETERMINING YARDAGE GAINED OR LOST ON THE PLAY.

Y RANDOM NUMBER VARIABLE

| # | BINARY EQUIV. | PASSER SACKED PLAY CHOSEN | | | | LOSS ON RUN PLAY CHOSEN | | | | CODING AS APPEARS IN ROM MEMORY (OCTAL) |
|---|---|---|---|---|---|---|---|---|---|---|
| | | 1 | 2 | 3 | 4 | 5 | 6 | 7 | 8 | |
| 1 | 0000 | 1 | 1 | 1 | 1 | 1 | 1 | 1 | 1 | 377 |
| 2 | 0001 | 1 | 1 | 1 | 1 | 1 | 1 | 1 | 1 | 377 |
| 3 | 0010 | 1 | 1 | 1 | 1 | 1 | 1 | 1 | 1 | 377 |
| 4 | 0011 | 1 | 1 | 1 | 1 | 0 | 0 | 0 | 0 | 360 |
| 5 | 0100 | 1 | 1 | 1 | 1 | 0 | 0 | 0 | 0 | 360 |
| 6 | 0101 | 0 | 0 | 0 | 0 | 1 | 1 | 1 | 0 | 16 |
| 7 | 0110 | 0 | 0 | 0 | 0 | 1 | 1 | 0 | 0 | 14 |
| 8 | 0111 | 0 | 0 | 0 | 0 | 0 | 0 | 0 | 0 | 0 |
| 9 | 1000 | 0 | 0 | 0 | 0 | 0 | 0 | 0 | 0 | 0 |
| 10 | 1001 | 0 | 0 | 0 | 0 | 1 | 1 | 1 | 0 | 16 |
| 11 | 1010 | 0 | 0 | 0 | 0 | 1 | 1 | 1 | 0 | 16 |
| 12 | 1011 | 0 | 0 | 0 | 0 | 1 | 1 | 1 | 0 | 16 |
| 13 | 1100 | 0 | 0 | 0 | 0 | 1 | 1 | 1 | 0 | 16 |
| 14 | 1101 | 0 | 0 | 0 | 0 | 1 | 1 | 1 | 1 | 17 |
| 15 | 1110 | 0 | 0 | 0 | 0 | 1 | 1 | 1 | 1 | 17 |
| 16 | 1111 | 0 | 0 | 0 | 0 | 1 | 1 | 1 | 1 | 17 |

FIG_10a

X RANDOM NUMBER VARIABLE

| # | BINARY EQUIV. | YDS GAINED | | | | YDS LOST | | | | CODING AS APPEARS IN ROM MEMORY (OCTAL) |
|---|---|---|---|---|---|---|---|---|---|---|
| | | 1 | 2 | 3 | 4 | 5 | 6 | 7 | 8 | |
| 1 | 0000 | 0 | 1 | 0 | 0 | 0 | 1 | 0 | 0 | 104 |
| 2 | 0001 | 1 | 0 | 0 | 0 | 0 | 0 | 1 | 0 | 202 |
| 3 | 0010 | 0 | 1 | 0 | 0 | 0 | 0 | 1 | 0 | 102 |
| 4 | 0011 | 1 | 0 | 0 | 0 | 0 | 0 | 0 | 1 | 201 |
| 5 | 0100 | 0 | 1 | 0 | 0 | 0 | 0 | 0 | 1 | 101 |
| 6 | 0101 | 1 | 0 | 0 | 0 | 0 | 0 | 0 | 1 | 201 |
| 7 | 0110 | 1 | 0 | 0 | 0 | 0 | 0 | 1 | 0 | 202 |
| 8 | 0111 | 1 | 0 | 0 | 0 | 0 | 0 | 1 | 0 | 202 |
| 9 | 1000 | 1 | 0 | 0 | 0 | 0 | 1 | 0 | 0 | 204 |
| 10 | 1001 | 1 | 0 | 0 | 0 | 0 | 0 | 1 | 0 | 202 |
| 11 | 1010 | 0 | 1 | 0 | 0 | 0 | 0 | 0 | 1 | 101 |
| 12 | 1011 | 0 | 1 | 0 | 0 | 0 | 0 | 0 | 1 | 101 |
| 13 | 1100 | 0 | 1 | 0 | 0 | 0 | 0 | 0 | 1 | 101 |
| 14 | 1101 | 0 | 0 | 1 | 0 | 0 | 0 | 0 | 1 | 41 |
| 15 | 1110 | 0 | 0 | 1 | 0 | 0 | 0 | 1 | 0 | 42 |
| 16 | 1111 | 0 | 0 | 0 | 1 | 0 | 0 | 1 | 0 | 22 |

FIG_10b

ELECTRONIC GAME APPARATUS AND METHOD

BACKGROUND OF THE INVENTION

1. Field of the Invention

This invention relates to an electronic game that simulates an athletic contest, and more particularly to an electronic game wherein all play action is automatically generated, with the offensive player and the definsive player required only to choose from a plurality of possible play strategies.

2. Description of the Prior Art

Prior art electrical football games have required a great deal of player effort and interaction. Placement of players on the field, keeping track of the score, the numbers of downs played, yards to go for a first down, etc., have all been required to be performed by the players themselves. The games have had various randomizing means for varying the results generated by a given chosen play, but these means either comprise a drum that is manually rotated or buttons that are pushed to generate a play randomizing result. The more sophisticated of the games only provide sixteen different play results for each chosen play. Furthermore, only the play result is indicated, usually simply by lighting a single light under a given play result indicator. No real-time display of the actual execution of the play is provided. Another limitation is that in most such games, the players must keep track of time left in the game. No automatic means for keeping time or for providing a penalty if either side delays the game are supplied.

SUMMARY OF THE INVENTION

The present invention provides apparatus for simulating, in an accurate and realistic way, an athletic contest on an electronic playing field. Opposing players are supplied a keyboard, with various plays selectable by the person presently on offense, and various play strategies selectable by the person presently on defense, with play results generated automatically based on probabilities corresponding to those representing the actual sport, and based on random numbers generated by the apparatus. The apparatus provides for an extensive number of possible results for each play, the number being almost equal to the number of possible results experienced in the actual sport. Once the play has been chosen by the offensive player and the play strategies chosen by the defensive player, all the rest of the calculations, including the play outcome determination, the play execution determination and the display of the play execution is automatically performed. The apparatus includes a game controller comprising a microprocessor controlled by a processor controller permanently contained in a read-only memory, a random number generator, and a plurality of probability tables, also stored in a memory. Also included is a scoreboard which, under the control of the game controller, automatically displays the present game score, the game time remaining, whether there exists a penalty for delay of game, and other information required by the players.

The play outcome and execution computations, under the control of the game controller, are performed in a time span that is short as compared with real time, so that no delay in the game is detected therefrom by the players. The computations include the obtaining of random numbers from the random number generator and the using of these numbers along with the play and the play strategy chosen to access specific locations in the probability tables, for determining play success parameters thereby. With this information, the game controller displays, automatically in real time, the actual path of the play execution on the playing field including offensive and defensive formations. An array of light-emitting diodes is the playing field display apparatus for the present embodiment.

Accordingly, it is an object of this invention to provide an apparatus, including a microprocessor and a processor controller for electronically simulating an athletic contest.

Another object of this invention is to provide a game wherein the players can use their skill and knowledge of the sport to receive an advantage, and wherein also is incorporated the element of luck, which is also basic to the sport.

Another object of this invention is to provide a random sample procedure that insures that many results are possible when the same strategy moves are made by each player.

Another object of this invention is to provide a game that is fully automatic, including the scoring of the game, keeping track of the time left in the game, etc., and including the display on the playing field, in real time, of offensive and defensive movement, and the movement of the game play, with the only action required of the participants being the pressing of a button prior to every play.

A further object of this invention is to provide a game whereby all results are determined almost instantly, but displayed in the same time frame as would be experienced in the actual athletic contest.

BRIEF DESCRIPTION OF THE DRAWINGS

These and other objects and advantages of the present invention will become more apparent upon reference to the following description and accompanying drawings, in which:

FIG. 1 is a perspective view of a football game, according to the present invention;

FIG. 2 is a top plan view of the simulated playing field shown in FIG. 1;

FIG. 5 is a block diagram of the electronic components of the present invention;

FIGS. 10*a* and 10*b* depict two typical probability tables of the present invention.

DESCRIPTION OF THE PREFERRED EMBODIMENT

Figure 4:
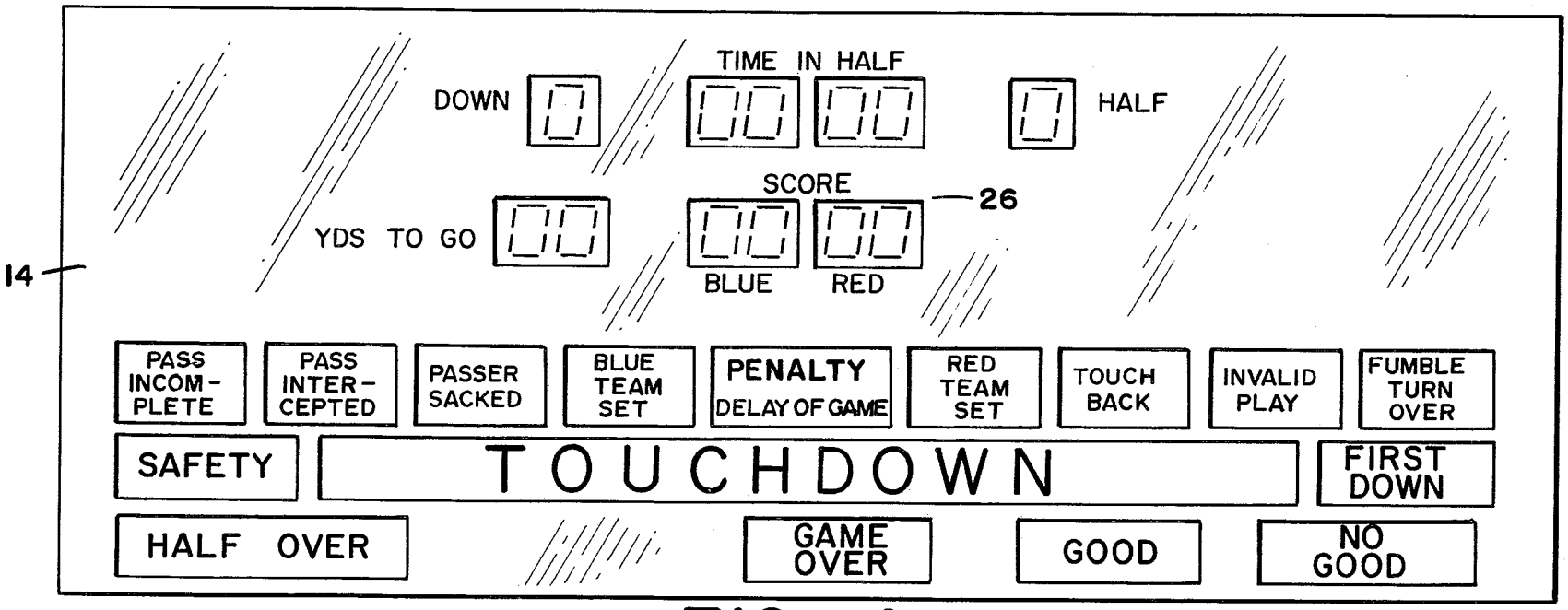
FIG. 4 illustrates a preferred embodiment of the scoreboard of the present invention.

FIG. 1 illustrates an electronic football game apparatus 10 according to the present invention. The game 10 includes a simulated playing field 12, a scoreboard 14, and two player keyboards 16, 17 (one shown) placed on each side of the playing field 12. Also included is a conventional power supply 18 for converting an AC power source into the voltage levels needed for operation of the game 10 electronics.

The simulated playing field 12, shown more fully in FIG. 2, includes an array 20 of light-emitting diodes (LED's) mounted on a printed circuit board (not shown) directly beneath the surface of the field 12. The array 20 is organized in five rows of fifty-three diodes each for a total of two hundred sixty-five LED's. On a scale where the playing field 12 simulates a field of 100 yards from one goal line to the other goal line, each light is spaced at two yard intervals down the length of the field, with a light at each end of every row positioned two yards into the end zone. Having five rows of lights extending in parallel lengthwise on the field permits play movement to be displayed both down the field 12 and across the field 12. Note that the number of rows and lights in each row is arbitrarily determined and can vary according to economic and space limitations. The playing field 12 surface is plastic, with the yard lines and numerals added by silk-screening or an equivalent process. The playing field 12 is translucent so that the array 20 of LED's is not visible unless an individual LED is on and emitting light. The surface acts as a lens for the point source LED's, thus providing a planar light on the playing field 12 surface that is visible at almost any angle of viewing. Note that all the LED's used in the present embodiment emit only red light, whether the light is indicating offense or defensive movement. The LED array 20 functions to display to the game players the path of the offensive play, i.e., the location and movement of the ball, and the location and movement of five defensive players. To distinguish the two, the defensive player lights pulsate while the ball light appears to be continuously lit. As will be explained hereinafter, however, the ball light also pulsates at a rate that is fast enough to normally be undiscernible to the human eye.

Figure 3:
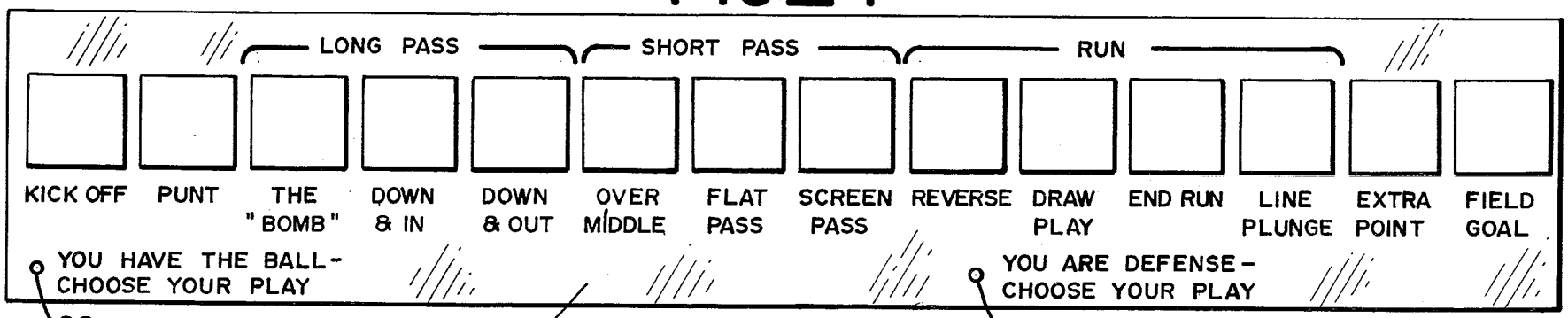
FIG. 3 illustrates a preferred embodiment of a player keyboard with various play buttons thereon.

FIG. 3 illustrates in detail one of the two keyboards 16, 17 indicated in FIG. 1. The keyboards 16, 17 are identical and include fourteen buttons or keys each, as seen in FIG. 3. The keyboards 16, 17 are physically arranged such that each player's button choice is out of the normal line of sight of the other player. The buttons include "KICK-OFF", "PUNT", "EXTRA POINT", "FIELD GOAL", and ten available line-of-scrimmage plays common to an actual football game. On plays from scrimmage, the offensive player presses a button to choose his next play, and the defensive player tries to anticipate the offensive player's chosen play by pressing what he thinks is the same button on his keyboard. If any of the first four buttons described above are pushed by the offensive player, however, the defensive player does not need to attempt a counteracting strategy. In addition, to ensure that the players know who presently is on the offensive, i.e., who has "possession" of the game ball, an LED 22 or LED 24 on each keyboard 16, 17 will light up respectively next to "YOU HAVE THE BALL — CHOOSE YOUR PLAY" or "YOU ARE DEFENSE — CHOOSE YOUR PLAY" to indicate the present game status of each player.

FIG. 4 illustrates in detail the preferred embodiment of the scoreboard 14 of the present invention. The scoreboard includes a plurality of seven-segment LED numeral indicators, such as at 26, for display of game score, time left in the half, etc., and a plurality of game messages that are individually illuminated from behind by incandescent lights (not shown). The messages are silk-screened or otherwise added to the plastic surface of the scoreboard 14, making the scoreboard translucent thereby. The messages are generally self-explanatory and reflect standard football occurrences. "BLUE TEAM SET" and "RED TEAM SET" messages light up when the respective player has selected his play and pressed the corresponding button. The "INVALID PLAY" message lights up if one of the players presses a button that is inappropriate for the current game situation, e.g. pressing a KICK-OFF button when a play from scrimmage, such as a "SCREEN PASS", is needed. (The means for providing this check mechanism will be described in detail infra.) The "GOOD" and "NO GOOD" messages indicate whether an attempted extra point or field goal has been successful or not.

The main electronic components of the football game 10 are shown in block diagram form in FIG. 5. A game controller, indicated generally within dotted lines 30, is the means by which every operation in the game 10 is controlled. Specifically, the controller 30 includes a microprocessor and state decode 32, a processor controller contained in a read-only memory (ROM) 34, a random access memory (RAM) 36, a data input multiplexer 44, and other components described further hereinafter. A ROM is used because the control program acts as a permanent component of the game 10. No change in the control program is desired or possible once the ROM 34 has been modified to reflect the steps of the control program therein. The RAM 36 is needed as a scratch-pad memory to store values needed during a given played game, e.g. to store the time left in the game, where the ball currently is located on the playing field 12 (i.e., which LED in array 20 is presently lit to indicate the ball position), the number of downs remaining, etc. All these values change from game to game, and within a given game. Further, many values change during each given play.

Access to the ROM 34 and RAM 36 is via a bidirectional processor bus 90. An address register 38, loaded by the microprocessor 32 via the processor bus 90, defines what storage location in each memory 34, 36 is accessed by the microprocessor 32. The address register 38 performs this function by communicating the address loaded by the microprocessor 32 to the memories 34, 36 via an address bus 96. This address continues to appear on the address bus 96, during an instruction fetch or memory read/write, until a new address is loaded into the address register 38 by the microprocessor 32.

Data is inputted to the microprocessor 32 by means of the data input multiplexer (MUX) 44. The input MUX 44 operates to selectively enable the passage of data that is inputted to the MUX 44 on one of two buses to its output bus, which in this case is the bidirectional processor bus 90, or to block any output thereto. One of the inputs to the input MUX 44 is a memory bus 94, which contains data being outputted from a given addressed word in either the ROM 34 or RAM 36. Specifically, a given address on the address bus 96 addresses a single memory word which may be in either the RAM 36 or the ROM 34. Note that no address will access a memory word in both memories at the same time. Thus, the outputs of both memories 34, 36 can be connected to the single memory bus 94. The addressing of a given word in either memory causes the data stored at that memory location to automatically be coupled to the memory bus 94, and thereby to the input MUX 44.

Data can also be written into the RAM 36 for temporary storage therein. Once a desired address has been loaded into address register 38 via processor bus 90, the bus 90 is again available for the microprocessor 32. The microprocessor 32 couples data via this bus 90 to the memory word in the RAM 36 identified by the stored address in register 38, to thereby store this data in that addressed memory word location.

The other bus connected to the input MUX 44 is the input data bus 92. This bus 92 couples selective information from either the blue team keyboard switches 16 or the red team keyboard switches 17. Switches 16, 17 are selectively accessed by the microprocessor 32 via the address register 38, which acts as a temporary command storage register, and address bus 96. The address bus 96 data is decoded in an input gate select decode 46, which acts thereby to select which of the switches 16, 17 will be read into the microprocessor 32 via the input data bus 92 and the input MUX 44.

Output display components, such as LED array 20 and scoreboard 14, are also accessed by the microprocessor 32 by means of the address register 38, again acting as a temporary command storage register. In this case, part of the data resultant on address bus 96 is decoded by an output enable address decoder 48 for generating output enable commands OP$\phi$ through OP7 which selectively enable one of the eight output blocks of game indicators (whether incandescent message indicators or LED's). The rest of the data on the address bus 96 is used to further select a given indicator within the block chosen by the generated output command. This subassembly will be described in greater detail below.

The functioning of game 10 begins by the detection by a coin detector 40 of the deposit of the requisite amount of money into the game. Note that a simple start push-button would be just as easily usable for this function. The coin detector 40 communicates this game starting condition to the microprocessor 32. The microprocessor 32 is thereby forced to access a given word in the processor controller, i.e., in the control program, which enables the program to begin.

The Microprocessor and State Decode.

The main element of the game controller 30, and therefore the game 10, is the microprocessor and state decode 32. This unit is shown in more detail in FIG. 6. In conjunction with the processor controller stored in the ROM 34, the microprocessor and state decode 32 is the main supervisor of all aspects of the operation of the game 10. All input data passes through the microprocessor 32 and all output data, control, and memory address information is generated through this unit. A typical type of microprocessor includes the INTEL 8008 eight-bit parallel word microprocessor unit, as described in the INTEL 8008 User's Manual, Rev. 4, November 1973, with some additional control circuitry as described below.

Figure 6:
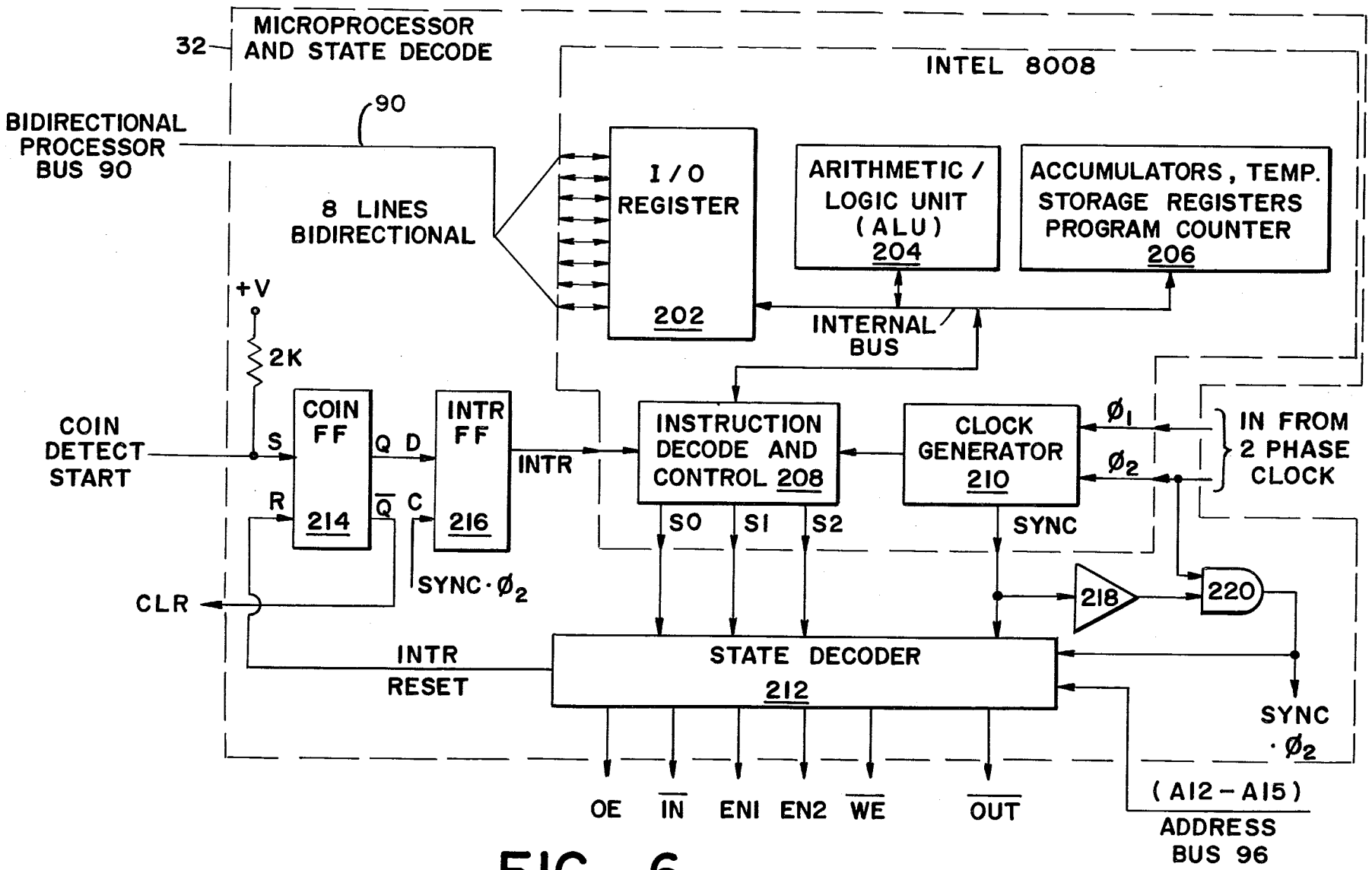
FIG. 6 is a block diagram and partial schematic of the microprocessor and state decode unit shown in FIG. 5.

Referring to FIG. 6, the microprocessor 32 communicates over eight bidirectional lines on the processor bus 90. Time multiplexing of the processor bus 90 allows control information, addresses, and data to be transmitted between the processor and external components on this one bus, as described above.

The microprocessor 32 is controlled internally by an instruction set of forty-eight instructions, including data manipulation, binary arithmetic, and jump-to-subroutine instructions. Besides the use of the processor bus 90 for control, other devices may be controlled by the microprocessor 32 with the use of the S0, S1, S2 and SYNC output control lines generated by the INTEL 8008. In the present embodiment, the S0, S1, S2 and SYNC lines are decoded in the state decoder 212 to create the microprocessor 32 control signals of output enable (OE), keyboard switch input enable ($\overline{IN}$), load lower order address word into address register 38 (EN1), load higher order address into address register 38 (EN2), enable writing of the RAM 36 ($\overline{WE}$), and enable output from the output enable address decoder 48 ($\overline{OUT}$).

The various registers in the INTEL 8008 include the input/output register 202, the arithmetic/logic unit 204, which implements the addition, subtraction and logic operations called for by the instruction set, and the accumulation, memory, and program counter registers 206, which among other functions provides temporary storage for data being operated on and for subroutine return addresses. The instruction decode and control unit 208 provides the logic for manipulating the registers 202, 206 and the arithmetic unit 204 based on the type of instructions read in and decoded by the INTEL 8008. The timing of the INTEL 8008 and thus the game 10 is regulated by a clock generator 210 that operates from an external two-phase clock 42 (see FIG. 5). The clock 42 is a digital circuit that outputs digital pulses at a specific frequency. Normally, the time between pulses is on the order of $10^{-6}$ seconds.

The coin detector 40 acts to start the microprocessor 32 by setting a coin flip-flop 214 which enables the interrupt (INTR) flip-flop 216 to turn on at the next proper clock time which in the present embodiment is at time SYNC$\cdot\phi_2$. This clock time is generated by inverter 218 and AND gate 220. The output of the INTR flip-flop 216 is coupled to the INTR input of the INTEL 8008, which thereby forces the INTEL 8008 to access the first location word in the ROM 34. For further information on how the INTEL 8008 operates in this regard, the INTEL 8008 User's Manual, referred to above, is incorporated by reference.

As shown in FIG. 6, the state decoder 212 takes the S0, S1, S2, and SYNC outputs of the INTEL 8008 along with three lines (A12 – A15) from the address bus 96 and the SYNC$\cdot\phi_2$ to generate the above-listed output signals. The IN signal operates to select whether the input data bus 92 information or the memory bus 94 information is to pass through the input MUX 44. The OE signal also is inputted to the input MUX 44 and acts to enable the outputting of the MUX 44 selected data to the processor bus 90, or to block the input MUX 44 from affecting the state of the processor bus 90. In other words, the input MUX 44 outputs are tri-state outputs wherein, besides the existence of the normal digital levels of high ("1") and low ("0"), there is also a third level available which, when being produced, causes the input MUX 44 to not affect the state of the bus 90. Such tri-state logic devices are conventional and familiar to persons experienced in the art of digital logic design.

The $\overline{IN}$ signal, when energized to enable the input data bus 92 data to be coupled through the MUX 44, as above, also acts as the strobe to enable the status of a chosen set of switches to be outputted onto the input data bus 92. In the present embodiment, there are fourteen switches on each keyboard 16, 17, as shown in FIG. 3. As seen in FIG. 5, two address lines (A9–A10) from the address bus 96 are decoded by the decode 46 into four lines A-D. Each line A-D, when strobed on by $\overline{IN}$, enables seven switches to be sensed on the input data bus 92. Thus, lines A and B selectively enable the two groups of seven switches on the blue team keyboard 16 and lines C and D selectively enable the two groups of seven switches on the red team keyboard 17.

With regard to the other control signals produced by the state decoder 212, the write enable ($\overline{WE}$) signal tells the RAM 36 whether the microprocessor 32 wishes to read data out of or load data into the RAM 36. The enable 1 (EN1) and enable 2 (EN2) are control signals that selectively enable either the lower order eight bits of the address register 38 to be loaded from the bidirectional processor bus 90 by energizing EN1, or for loading the higher order word in the address register 38 via the processor bus 90 by energizing EN2. The clear (CLR) signal is generated in the microprocessor 32 when the coin detector 40 has detected that a game is to begin. The CLR signal causes the address register 38 to be reset, such that only digital zeros are on the address bus 96. Thus, the address accessed by the register 38 is the 0000 address of the ROM memory, that contains the initial instructions for starting up the game controller 30. The $\overline{OUT}$ signal controls when the output enable address decoder 48 is able to be controlled by information on the address bus 96 to thereby generate the output enable commands OPϕ — OP7. Note that a detailed understanding of how the above-described signals are produced by the state decoder 212 is not necessary to appreciate the present invention. Reference to the INTEL 8008 User's Manual should permit a person of ordinary skill in the art to produce the specific control circuitry necessary to provide the described signal operations.

The Memory Sub-System.

As mentioned above, the present memory sub-system of the game 10 comprises a ROM 34 and a RAM 36. The ROM 34 of the present embodiment is a memory of over 4,000 octal words of eight bits each. Besides the processor controller, which occupies most of the ROM 34, an additional 256 words are used to permanently store probability data that is needed by the game 10. The RAM 36 provides 256 words of read/write memory, also organized in eight-bit words, which are used for temporary storage of program variables and for scratch-pad manipulation. As will be described below, the processor controller is divided into several basic routines: clear and start; time and display strobe; keyboard handler; random number set; play outcome determination; play execution; and end play routines.

As described above, the address register 38 is divided up into a low order word and a high order word. In the present embodiment, each word is eight bits in length, for a total of sixteen bits of information available on the address bus 96. The memory locations in both the ROM 34 and the RAM 36 are accessed by the lower order eight bits and four of the higher order bits of the address register 38 to enable the addressing of 7777 different octal memory locations. The higher order eight bits generally are available for decoding in the input gate select decode 46, and in the output enable address decoder 48 to generate strobe signals thereby, including the A-D signals for the keyboards 16, 17 and the states described below, used to actuate the LED's and the incandescent lights of the game 10.

In operation, the processor controller is used by the microprocessor to control how the microprocessor 32 itself operates upon the game 10 components. During each instruction cycle of the INTEL 8008, an instruction word from the ROM 34 at the ROM 34 address location defined by the INTEL 8008 as being the next instruction, is loaded into the INTEL 8008. There, during the given instruction cycle, it is decoded in the instruction decode 208. the INTEL 8008 then proceeds to perform whatever function has been given to it by the processor controller instruction. Thus, although in this specification the control of the game 10 is described to originate in the microprocessor 32, it is noted that the processor controller is always an integral part of the microprocessor 32 operation.

The Output Display Means.

As shown in FIG. 5, by means of the microprocessor 32, one is able to individually turn on each of the keyboard LED's 22, 24, all incandescent message indicators and seven-segment numerals on the scoreboard display 14, and all LED's in the array 20 of the playing field 12. This selection ability is provided via control information on the address bus 96 in conjunction with the OPϕ–OP7 output enable command lines generated by the output enable address decoder 48. The keyboard LED's 22, 24 and the incandescent lights constituting the message display portion of the scoreboard 14 (shown in FIG. 4) are selectively enabled by the latches and drivers 60 that are enabled by OPϕ–OP2 and the eight lower order bits of the address bus 96. Specifically, each output enable command enables an eight-bit latch to receive data from the address bus 96. Thus, with three latches having eight bits each, and with each controlled by a separate output enable command, twenty-four distinct output states are thereby created. Thus, each latch output is connected to a separate conventional incandescent light or LED driver, which in turn are individually connected to separate messages on the message part of the scoreboard 14 and to the four keyboard LED's 22, 24. In operation, merely by setting a specific one of the output enable commands OPϕλ –OP2 and then loading information bits onto the address bus 96, any of the twenty-four lights or LED's may be turned on thereby. Also, since eight bits are loaded into the latches at one time, the game 10 is not limited to turning on only one of the indicators within a given eight-bit latch. A maximum of all eight may be turned on, if desired, by one output enable command.

Figure 7:
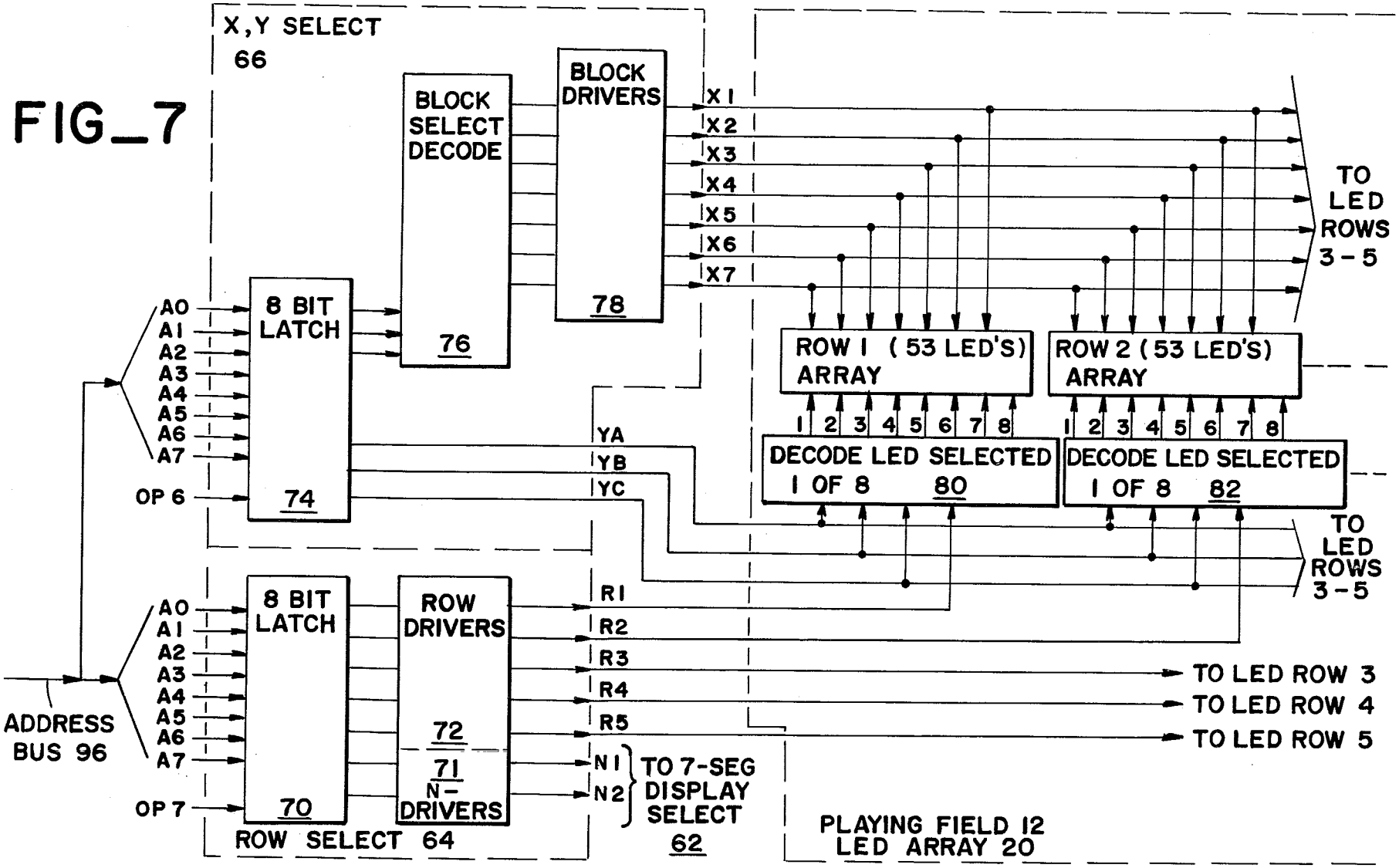
FIG. 7 is a partial schematic of the means for selectively actuating respective scoreboard and playing field lights.

Referringstill to FIG. 5, the seven-segment numerals in the scoreboard 14 are selectively enabled in a similar manner to the above incandescent lights, by means of latches and drivers 62. Data on the address bus 96 and the enabling commands of OP3–OP5 along with two other control signals N1 and N2 (generated as shown in FIG. 7) are used to control these numerals. Again, eight-bit latches are used for selectively enabling numerals. In this case, however, each numeral requires four bits of data. In a conventional way, each four-bit numeral block is decoded to the seven lines required to drive the seven-segment numerals. Note that there are twelve seven-segment numerals used by the game 10;

this implies that latches totalling forty-eight bits are required to individually control these numerals. Signals N1 and N2 act to cut in half this requirement, so that only three eight-bit latches are required. This result is obtained by tying the outputs of half of the numerals directly to the other half, and using N1 and N2 to alternately turn on each half at a rate that is fast enough to make it indiscernible to the human eye. Thus, all numerals in the game 10 appear to be continuously on, while using only one-half of the number of latches normally required.

The LED array 20 of the playing field 12 is selectively driven in such a manner so as to minimize circuit hardware. This is done by means of a three-axis type of drive, including X, Y and ROW-SELECT lines. The ROW-SELECT latches and drivers are shown at 64 in FIG. 5, X and Y latches and drivers at 66 (see also FIG. 7). The five ROW-SELECT lines define which of the rows in the LED array 20 will have an LED selected, the seven X lines define which of the seven blocks of six to eight LED's each is selected within a given row, and the three Y lines define the position selected with the LED block selected. Thus, these three sets of lines are used to selectively light any one of the LED's in the LED array 20. Note that only one LED is lit at any one time. As will be described fully infra, six LED's appear to the players to be lit on the field at all times, one on offense and five on defense. Only one such LED need be actuated at any one time, however, since each one is strobed many times in a given second.

FIG. 7 illustrates in detail the operation of the LED array 20 selection means of X, Y and ROW-SELECT drivers. The two output enable commands used for accessing the LED array 20 is OP6 and OP7. OP7 enables the loading of eight bits of data from the address bus 96 (Aϕ–A7) to an eight-bit latch 70 in the ROW-SELECT unit 64. Five of the eight latches 70 are fed through row drivers 72 to be outputted as the ROW-SELECT lies to the array 20. Two of the lines from the latch 70 are coupled through N drivers 71 to become the N1 and N2 lines, mentioned previously, for controlling the alternating of the actuation of the seven-segment numerals on the scoreboard 14.

OP6 enables the loading of eight bits of data from the address bus 96 (Aϕ–A7) to an eight-bit latch 74 in the X, Y select unit 66. Three of these eight latches are outputted directly as the Y SELECT lines to the array 20. Three other of these latches are coupled to the X decode 76 where they are decoded to the required seven X SELECT lines. These lines are fed through the X drivers 78 for output as the X SELECT lines to the array 20.

Due to the amount of interconnections reqired, the Y SELECT lines are decoded in a conventional way at the array 20. Five decoders 80, 82, 84, 86 and 88 (only two of which are shown in FIG. 7) are each used to generate eight outputs corresponding to the eight LED's maximum in each block of each row. In row 1, for example, to enable a given LED in this row, the ROW SELECT R1 line must be energized. This enables Consequently, each decode 80 to operatively generate an output on the line corresponding to the decoded state of the inputted Y SELECT lines, e.g. line 2. In operation, the selected output line in the decode 80 creates a low or ground signal, which is presented to the same-positioned LED in each X block of row 1, e.g. the second LED in each block has one side grounded. Thus, when a specific block is selectively enabled, say block X3, the X3 line gets energized to create a voltage drop only across the LED in block X3 that has its other side grounded. Consequently,each combination of ROW, X and Y SELECT lines provides for one specific LED to be lit on the playing field 12.

The Processor Controller

Figure 8A:
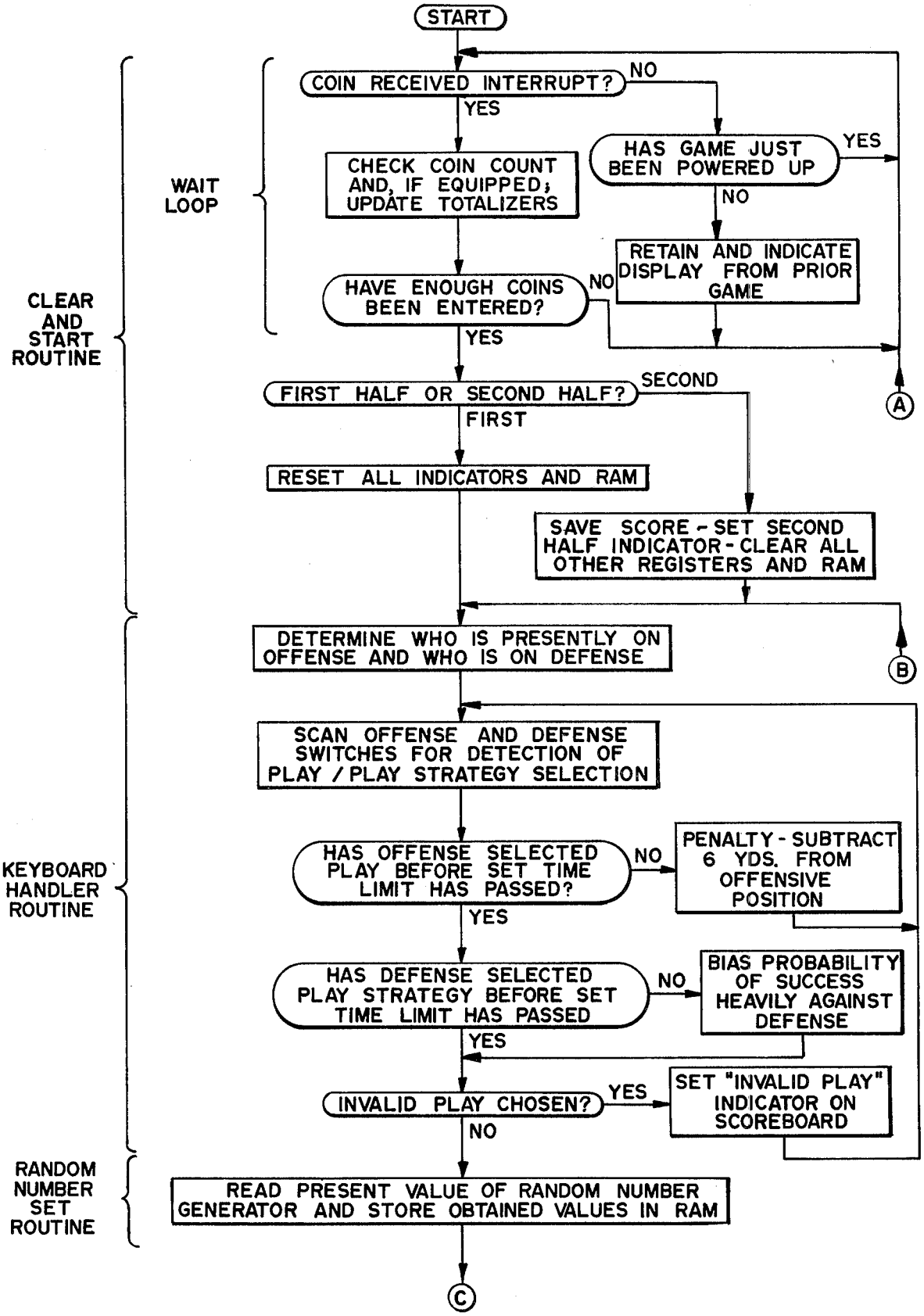
FIG. 8 is a flow diagram shown on 3 sheets 8*a*, 8*b* and 8*c* of the control program stored in the read-only memory shown in FIG. 5.
Figure 8B:
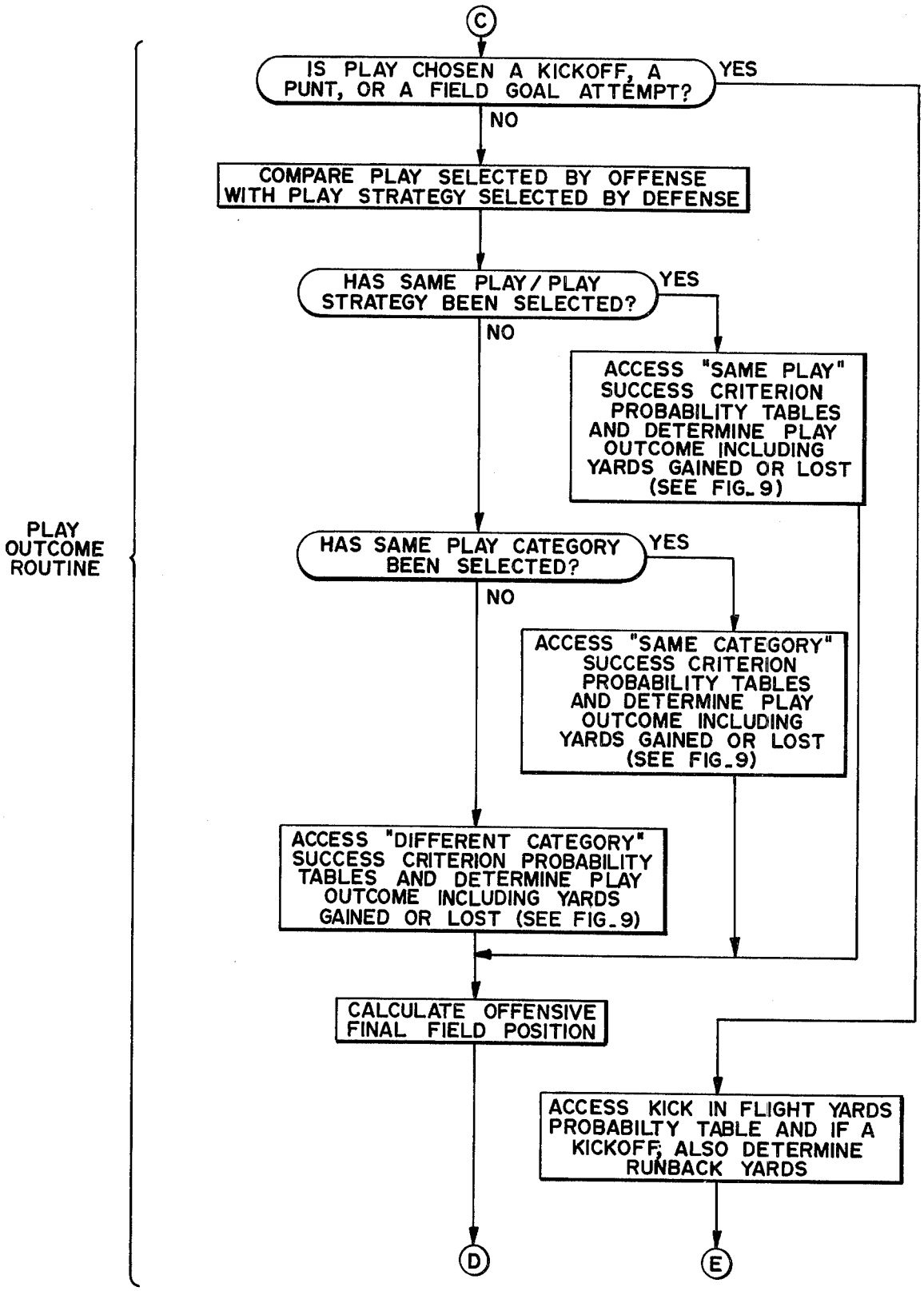
Figure 8C:
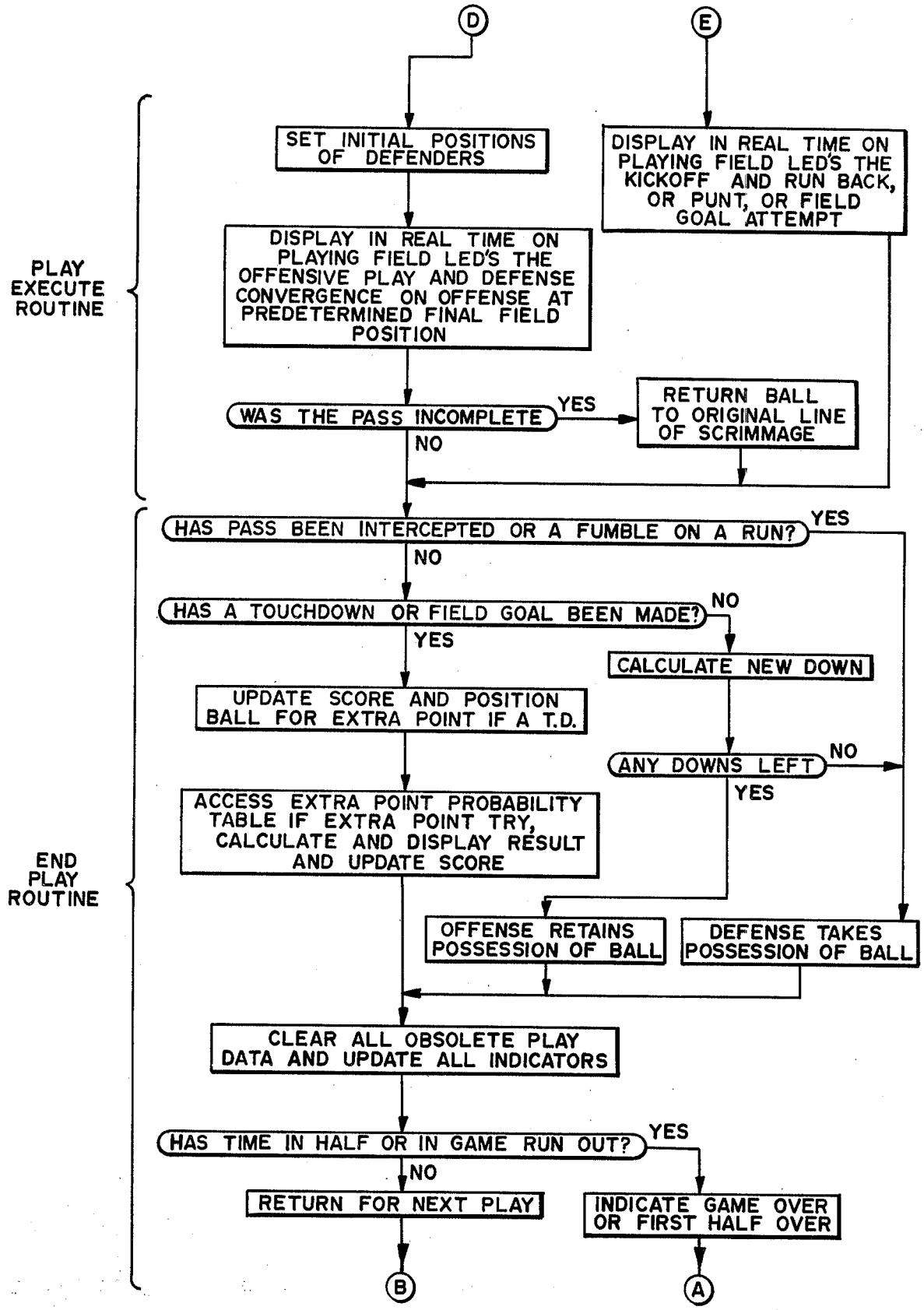
Figure 9:
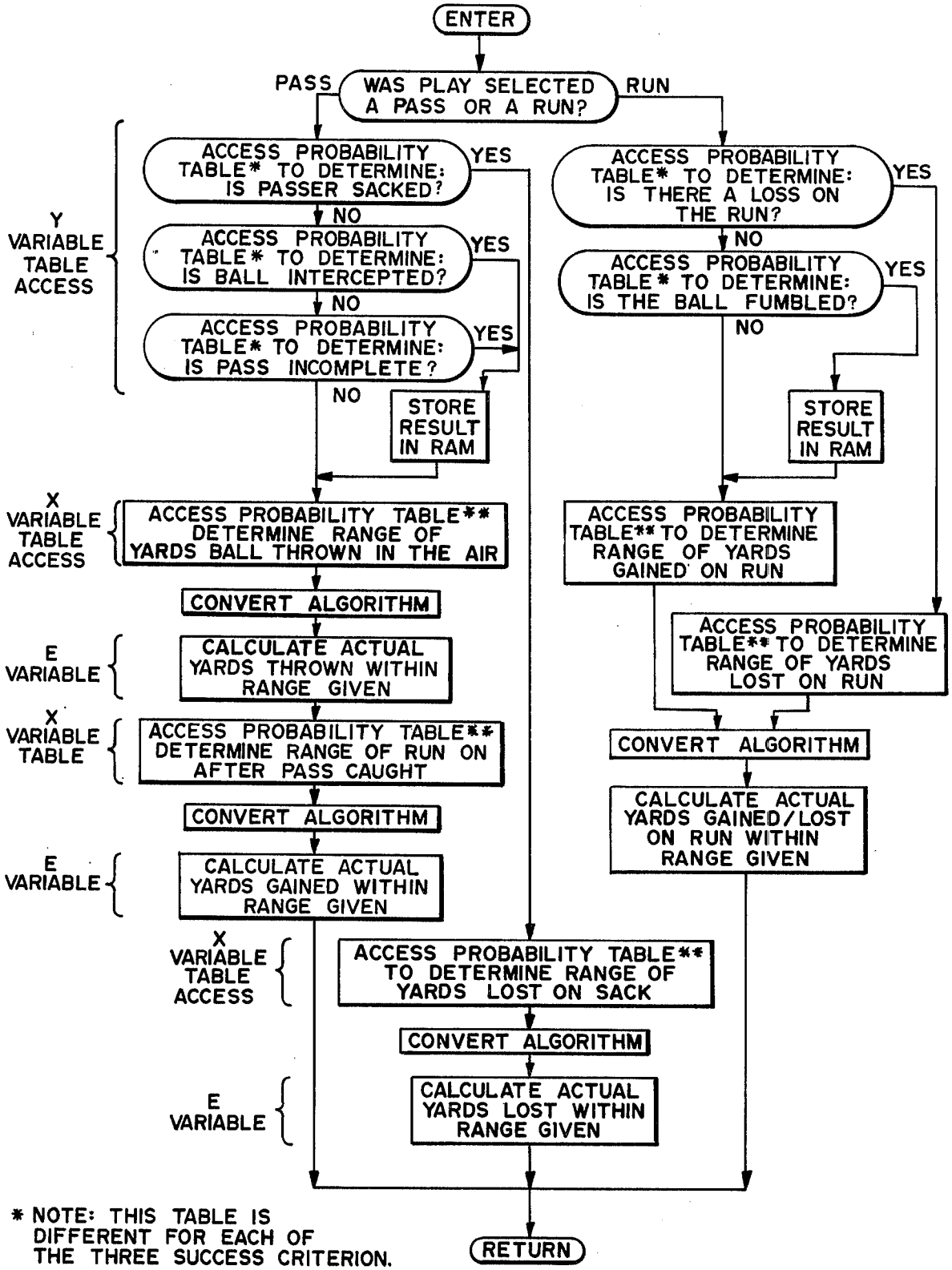
FIG. 9 is a detailed partial flow diagram of the play outcome aspect of the flow diagram of FIG. 8.

An illustrative embodiment of the processor controller for the game 10 is shown in flow-chart form in FIGS. 8 and 9. The processor controller described herein is for simulating a football game. Controllers for simulating other athletic contests are also applicable to the game controller 30 and associated electronics, shown in FIG. 5. To modify the game 10 to simulate a different athletic contest, one would only have to change the message on the scoreboard 14, perhaps rearrange the array 20 on the playing field 12, and replace the ROM 34 containing the football processor controller with a ROM 34 containing a controller simulating a new athletic contest.

The present processor controller for football is divided up, as mentioned above, generally into several basic routines. The clear and start routine is the first routine performed by the controller. The clear and start routine makes sure the controller is initiated at the proper point. The time and strobe display routine make sure all message indicators and seven-segment numerals are constantly kept updated. The routine further keeps track of game time remaining and enables play execution to have a time frame approximating the time taken for the given play to be executed in an actual football game, i.e., in "real time". The time remaining in the game is also displayed on the scoreboard 14 in real time, which in the present embodiment is ten minutes per half. However, the game 10 processor controller can be set to indicate a different time allowed per half or it can operate at a speed faster or slower than real time, e.g. a game displaying ten minutes per half that actually ends after seven minutes, even though the game time indicator shows ten minutes have passed. Finally, the play control cycle, incorporating the keyboard handler routine, the random number set routine, the play outcome determination routine, the play execution routine, and the end play routine are all accessed during each play of the game 10.

As illustrated in the flow chart of FIG. 8, when the game 10 first has power coupled to it, microprocessor 32 does not immediately begin operating. The microprocessor 32 can only wait until it is initialized by an interrupt signal. This interrupt signal enables the microprocessor 32 to address the starting instruction in the processor controller to thereby begin the game operation as embodied in the rest of the controller. As mentioned above, a start signal from the coin detector 40 provides this interrupt signal. Once the microprocessor 32 has been started up, it continuously runs until power is removed. Even between games, the microprocessor continues to run in a WAIT LOOP so that the scoreboard remains active. However, each new game begins by a new coin received interrupt of the microprocessor 32 to insure that again the processor controller is started at the proper point. Note that optional totalizer hardward can be added to keep track of the total number of games played, and that the coin detector 40 can be modifiable to allow the game owner to change the amount of coins required before a game can start.

Although the clear and start routine encompasses the above interrupt steps, the program-embodied part of the routine begins at the starting address of the processor controller. The routine first checks to determine if the second half is beginning or if the game is newly started. In the present embodiment, the players have buttons they can push to indicate their desire to play a second half or to start a new game. If a new game is desired, all message indicators and the RAM 36 memory are reset. If a second half is desired, the score is saved and the first half/second half indicator is updated on the scoreboard 14. The rest of the message indicators and the rest of the RAM 36 memory is reset as above. Finally, this routine beings the initial kickoff. The present game 10 displays a kickoff to the red team player at the start of the first half and a kickoff to the blue team player at the start of the second half.

The time and display strobe routine is periodically accessed during all phases of processor controller operation to both generate the proper "real time" components required to simulate a football game in real time and to update the displays 12, 14. The ability to generate real time is based on the fact that a given microprocessor 32 will usually have a relatively precise instruction cycle time, dependent mainly on the frequency of the clock 42. As a result, one can accurately predict how much time a given set of instruction, subroutines, etc., will take to complete. To generate real time, therefore, a register counter can be incremented periodically at set intervals during the running of the various instructions with a second of time being approximately generated after a certain number of counts has been reached. The present embodiment increments one of the registers 206 in the INTEL 8008 to generate real time, but any register counter can be equally as effective. A storage register 206 is used herein merely because fewer steps are required to increment it than would be required to increment a register external to the microprocessor 32. Thus, all the routines of the processor controller, except for the time and display strobe routine itself, are set up to automatically increment the register 206. In the present embodiment, this register 206 is a twelve-bit word. During game operation, register 206 is designed to count through all its states in one-half of a second, which means that it is incremented approximately 8,192 times a second. Thus, each time the processor controller increments register 206, it tests to see whether the register has counted through twice. If so, it decrements the game 10 realtime clock, displayed on the scoreboard 14, by one second. The time routine also keeps track of the fifteen second interval after the completion of each previous play. This is so that a delay of game penalty, as will be described below, can be initiated. Further, the time routine checks to see if a play is in progress, since if time in the half or in the game has ended, the game 10 is designed to ignore the time and allow the play to be completely played out prior to ending the game.

Each time the register 206 is incremented, the processor controller also checks to see how much time has elapsed since the last time the displays 12, 14 have been updated. The present embodied provides for updating of all game displays approximately every six milliseconds. Again, this updating is performed independently of where in the play control cycle routines the control program is currently operating. The reason for strobing the various displays 12, 14 is to minimize the drive hardward which would be required to drive each display 12, 14 if a strobe accessing scheme was not used. As discussed above, the strobe reduces the drive hardward on the scoreboard 14 by a half, by using the N1 and N2 control lines to alternately turn on half of the twelve seven-segment numerals for six millisecond periods each. On the playing field 12, the strobe reduces the drive hardware by using the matrix scheme of ROW, X, and Y SELECT lines. Note again that the method of alternately turning on numerals on the scoreboard 14 and light-emitting diodes on the playing field 12 is generally not noticeable because a six millisecond time frame creates a flicker that is generally faster than the human eye can discern.

Referring again to FIG. 8, after the clear and start routine has been completed or a previous play has ended, the play control cycle begins with the keyboard handler routine. This routine processes all keyboard entries to the game 10. The routine first determines which player is on offense and which on defense, then waits for each player to input a chosen play (play strategy if on defense). If a player on offense fails to choose a play on his keyboard 16, 17 prior to a fifteen second limit, a delay or game penalty result. The ball position is automatically indicated as being six yards farther from the offensive player's goal (not a five yard penalty as in actual football, because the LED's in array 20 are spaced at two-yard intervals on the playing field 12). The player then has another fifteen seconds to choose a play before another penalty results, and so on. The player on defense also has to make an input on his keyboard 16, 17. He chooses the play strategy that he hopes will match the play chosen by the offensive player, to increase his chances of thereby stopping the offensive play. If the defensive player fails to choose a strategy prior to the same fifteen second penalty period, the microprocessor 32 automatically heavily biases against the defense the probability that the offensive player will be stopped. More on this operation is given below. Note that it makes no difference which player makes his choice first. Lastly, the keyboard routine analyzes the plays chosen to determine if they are valid at the time they are inputted, e.g. selecting the extra point button when the offense has not yet made a touchdown is an invalid choice. An invalid play, when made, is indicated on the scoreboard display 14. The player then must choose a new play. When a valid play is chosen by each player, it is stored in an appropriate location in the RAM 36.

The next routine is the random number set routine. This is a very important routine because it prescribes all of the variables that will be used by the microprocessor 32 and the play outcome routine to manipulate the play outcome probabilities. There are three variables that are used. They are the X, Y and the E-random number variables. The present embodiment uses variables having sixteen unique states each, i.e., each are fout-bit words. The X, Y and E variables are random in that they are continuously being updated or incremented by the microprocessor 32 as it is performing other functions. This is because, in the preferred embodiment, the same register 206 that is used to keep track of real time is used here as a random number generator. An alternative would be to use a separate register counter. The register 206 is split up into three four-bit words comprising the X, Y and E variables. Thus, it takes approximately one-half of a second to completely go through all of the combinations in these three variables. It is felt that this sufficient time to insure the randomness of these variables, since many seconds go by between each random number set. The time when both keyboard 16, 17 play choices are received and are valid is the time when the variables, in whatever present state they are in, are frozen and stored in the RAM 36 for use by the microprocessor 32 as bases for calculating the outcome probabilities. Since it takes only microseconds for the microprocessor 32 to read and store the present state of register 206, the register is almost immediately free to continue being incremented by the microprocessor 32 so that real time can continue to be kept track of by the register 206, and so that the next time valid keyboard selections are received, the register will be in a completely different state therefor.

The play outcome determination routine uses the X, Y and E random numbers along with probability tables to calculate the play result or outcome for the play chosen by the offense. Initially, this routine scans the play chosen to see if a kickoff or punt is selected. Assuming for now that such a play was not selected, the routine compares the play chosen by the offense with the play strategy of the defense The routine is set up to access different probability tables, i.e., give different odds of success, depending on how well the defense anticipates the offense's play. In the present embodiment, note that the odds are set up to always favor the offense to some degree, to ensure that the game is more of an offensive contest rather than a defensive one. There are presently three sets of probability tables, i.e., three success criteria, depending on the play/play strategy match-up. If the defense chose the same exact play that the offense has chosen, the offense is only slightly favored. Should the defense choose a play in the same category as the play the offense has chosen, i.e., both chose a pass play or both chose a run play, the odds are somewhat more in favor of the offense. Should, however, the defense choose a play in a different category than the play that the offense chooses, the odds will be greatly in favor of the offense successfully executing the play. An alternate scheme could provide the defense with different defensive alignment buttons, e.g. "blitz" or "zone defense" alignment buttons, and in such a scheme, the odds of success or failure of a play would then be dependent upon the odds relating to the combination of the offensive play chosen and the defensive alignment chosen.

As shown in FIG. 9, even within the three types of success criteria of "same play", "same category", or "different category", different probability tables are used depending on whether a pass or run play has been chosen by the offense. In the present embodiment, each of the three success criteria contains five tables three of which are accessed if the play chosen is a pass play and two if the play chosen is a run play. Also, the three random numbers are utilized at different points to generate the overall play outcome. Specifically, the Y variable is used by the control program to access the basic success criteria probability tables. The X variable is used to access the probability tables wherein odds relating to the range of possible gain or loss distances for the run or pass play are stored as a function of the play chosen. Finally, the E variable is used to arithmetically determine the actual yardage within the given range of yards produced by the X variable for the play. Note that the E variable does not access a probability table, but merely acts to bias a range of yards to a specific yardage value.

FIG. 9 illustrates that if the pass play is chosen, a series of three tests are made in a given success criteria with a set of three probability tables, one for determining if the passer has been sacked, one for determining if the ball has been intercepted, and one for determining if there was an incomplete pass. If a run play is chosen, there are two tests made in a given success criteria with a set of two probability tables. These run tables test whether there is a loss on the run play, or whether a fumble has occured.

FIG. 10*a* illustrates the organization of a typical probability table for determining the success of a play. This particular table is the one accessed by the microprocessor 32 if the defense has chosen the same play as the offense, i.e., a "same play" success criterion table, so that the odds of the offensive play being successful are less. In the present embodiment, the table is organized as a combination of two probability tables, one for determining if the passer is sacked, and one for determining if there is a loss on the run. These two tables are combined merely for ease of memory organization. The numbers across the top of the table represent the specific play chosen. Numbers 1–4 indicate which pass play is chosen (since there are six possible pass plays to be chosen, as shown on the keyboard 16, 17 of FIG. 3, two of the possible pass play choices have been combined with similar pass plays to conserve memory space). Numbers 5-8 correspond to the four possible run plays. Thus, if the play chosen in a number 2 pass play, and if the Y variable comes up as one of the first five states listed out of a possible sixteen states, the offensive player will thereby suffer a loss on the play, since a "1" is shown in column 2, the column corresponding to a number 2 pass play. In other words, the passer sacked table is a two-dimensional array whose one axis is the play chosen and whose other axis is the Y variable generated by the random number set routine, so that each combination of a given play on the one axis with a given Y variable number accesses a unique bit of data in the table. Since all of the pass play columns in the example table have one's listed in the first five of the sixteen possible Y combinations, the odds of the passer being sacked in any pass play, for the success criterion of "same play", is five out of sixteen. This means the passer has about a 31% chance of being sacked on the play.

The right-hand column of the table shown in FIG. 10*a* illustrates how the information in columns 1–8 is coded into the ROM 34. Each word, illustrated here as an octal word, is stored in successive memory locations in the ROM 34. Thus, the Y variable is used to access the table by just adding the Y variable value to the starting address of the table (i.e., the address of the first octal word on the table). The octal word thereby located is then programmably masked in a conventional way so that only the information bit corresponding to the specific play chosen column number is left as a result. If this bit is a "1", the passer is sacked, and the microprocessor 32 goes on to determine the number of yards lost on the play. If this bit is a "0", the microprocessor 32 and processor controller go on to the next success criteria probability table and, in the same manner as above, tests whether the ball has been intercepted. Finally, if the ball is not found to be intercepted, the test of whether the pass is incomplete is made.

As shown in FIG. 9, once the success criteria probability tables have been accessed by the Y variable, the X variable is used to access the "range of yard" probability tables. Note that these probability tables may or may not be accessed depending on the outcome of the success criteria table tests, e.g. depending on whether there was a completed pass or not. Also, the table may be accessed for a gain in yards or a loss in yards. Finally, as seen in FIG. 9, the X table may be accessed more than once, e.g. first to determine the number of yards that the ball was passed in the air and secondly to determine the number of yards that the ball was run on after the pass was completed. The present program is organized so that each play has its own probability table for yardage gained or lost. Note that these tables only choose a range of yards, i.e., eight to sixteen yards, sixteen to thirty-two yards, etc., as a function of the X variable. The E variable provides the means for arithmetically calculating the exact yardage within the range selected by the X variable.

A sample yardage probability table is shown in FIG. 10*b*. Assume, for example, that this is the table used for an end run play. As can be seen, for most of the possible values of X, the gain or loss range on the play is either found in columns 1 and 2 or 7 and 8 e.g. a range of between zero and eight yards. The coding of this table into ROM 34 memory and its accessibility by means of adding its starting address to the X variable values is performed in a similar manner to the success criteria probability tables discussed above. However, the column found by masking the word found at the accessed address does not immediately indicate a given range. Some plays may use six columns for indicating yards-gained ranges, and only two columns for yards-lost ranges. Note that instead of having a specific column chosen to be masked, as is the case for the Y variable tables, these tables have only one bit in each yards-gained or yards-lost section. That is, only one "1" for each value of X per section. Thus, one must use the position of the "1" bit, i.e., its column location, to determine the yardage range. A convert algorithm provides this function. The algorithm knows that if the "1" bit was found in column 2, for example, in this end run play table, that this indicates a range of four to eight yards gained. If the table is being accessed to determine a yardage lost range, only the columns 5–8 are masked out with a "1" found in column 6, for example, indicating to the convert-algorithm that a loss of ten to fourteen yards is the range to be used. As mentioned above, the E variable is just used to calculate the exact yardage within the given yardage range selected by the X variable.

A different part is taken by the play outcome routine if a kickoff or punt play has been chosen. As shown in FIG. 8, here only the X and E variables are used. The X variable determines, via a kickoff and punt table, the range of yards that the ball was kicked in the air, and if the play was a kickoff, the X variable further determines, from a run-back yardage table, the range of run-back yards. Again, the E variable determines the actual yardage within the range selected by the X variable, for each such range.

Once the success criteria has been determined, and the number of yards gained or lost in the play are known, the last step in the play outcome routine is for the microprocessor 32 to take these yardage values and calculate what the final ball position will be based on the ball's present indicated field 12 position.

Once all the play outcome tests are made and the yardage values determined, the processor controller enters the play execution routine, wherein the play execution is displayed on the field 12 in real time. Note that the play outcome is calculated and determined by the microprocessor 32 prior to when the play is actually displayed on the playing field 12. This is because the play outcome routine takes advantage of the speed of the microprocessor 32 to complete all its above-described tasks in a fraction of a second. Since movement on the playing field 12 is simulating by means of turning on successive LED's along a chosen path in the array 20, the basic function of the play execution routine is to keep track of what LED's represent the defensive players, and which represents the ball, and to define a path for each. The present embodiment has five defender LED's lit to represent defensive positions, and one ball LED lit to show the offensive path. The players are distinguishable since the ball LED appears to be continuously lit while the defensive player LED's pulsate. The play execution routine, therefore, first sets the initial position of the five defenders on the playing field 12. Secondly, the pattern of the particular play (e.g. an end run play requires the ball to move to the side of the field before movement down the field 12 is begun), is combined with the variables determined in the play outcome routine just completed, to define a ball path thereby. The routine then, in real time, displays play action by manipulating the ball LED indicator LED's in such a manner as to relate a run with a slow movement and a pass or kick with a fast movement of the ball. The last step is to actually meld the defensive positions with the path of the offensive ball to cause the defenders to converge upon the ball in a run, and to set a defender, whether during a pass or run play, at the point of intercept or tackle where the final ball field 12 position is to occur, as calculated in the play outcome routine.

The final play control cycle routine is the end play routine. This routine is entered by the microprocessor 32 at the time the play is over, that is, at the tackle point, intercept point, fumble point, etc. This routine basically completes all outstanding tasks for the microprocessor 32, such as determining if a touchback, safety, touchdown, field goal, or etc., occured as a result of the play. At this point also the microprocessor 32 causes the appropriate lights on the scoreboard 14 to light reflecting the action that has taken place. Further, the microprocessor 32 checks the yardage gained to determine if a new first down has occured, and if so it establishes the new first down line. All of these determinations are made by the microprocessor 32 by arithmetic means and logic operations, in a conventional manner. Finally, in this routine all the various variables stored in the RAM 36 scratch-pad memory which were used to determine the just-completed play are cleared, After the housekeeping is completed, the time routine is checked to see if the game time has run out, and if not, the microprocessor 32 and control program then re-enters the keyboard routine to await selection of the next play be the game 10 players.

It should be noted that the above-described routines are given to show an illustrative embodiment. Other types of processor controllers wherein, for example, more or less probability tables are used or wherein the number of possible states for the one or more random numbers are different, are also deemed to be within the scope of the present invention.

DETAILED OPERATIONAL EXAMPLE

Figure 11A:
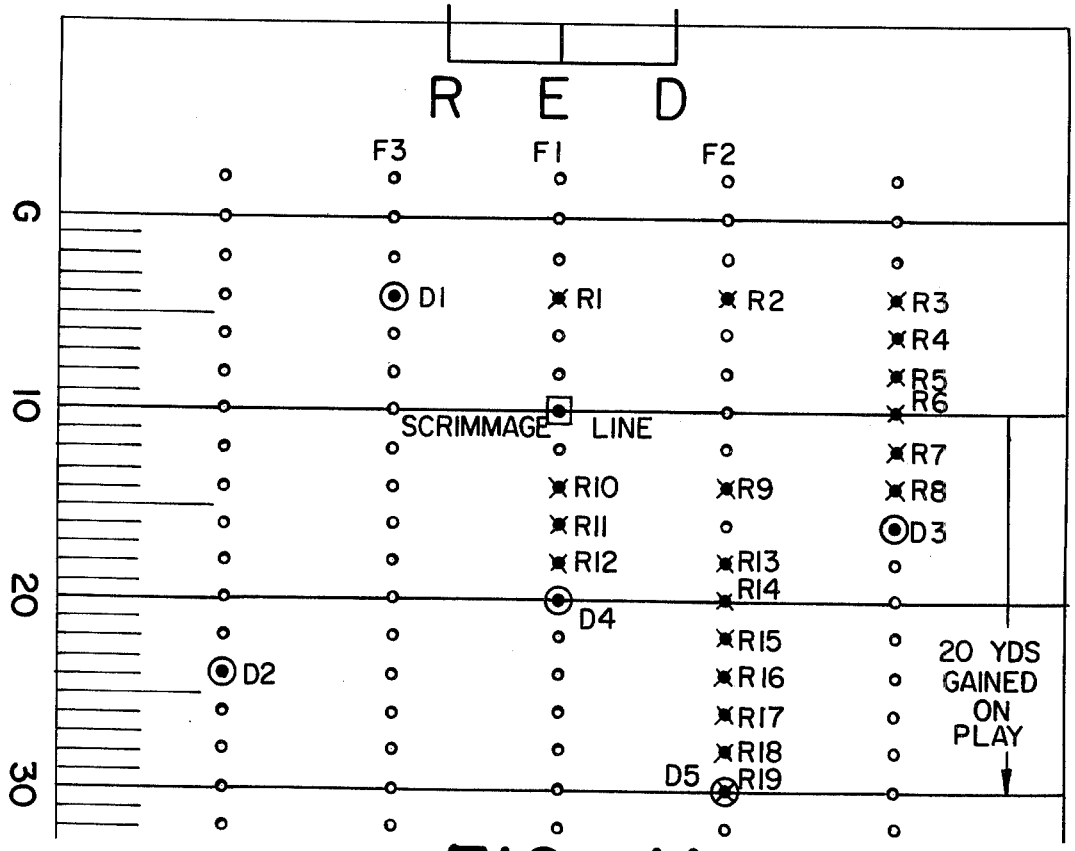
FIGS. 11*a* and 11*b* detail the layout of a section of the light array on the playing field, with FIG. 11*a* further showing a typical run play as executed, and FIG. 11*b* showing a typical pass play as executed.

An example of the two typical plays from the line of scrimmage will more clearly show the operation of this device. FIG. 11 *a* illustrates a sequence or path of an end run play on the playing field 12, with the blue team having the ball. FIG. 11*a* shows the ball initially on the ten-yard line. The X's indicate the path of the ball, the O's indicate the final position of the five defenders D1 through D5.

Assuming first that no loss on the play nor a fumble has occurred, the play action begins when the offensive ball light goes off at the scrimmage line and R1 goes on. Then, within the span of time roughly equivalent to an actual football end run play, e.g. five to six seconds, LED's R2-R19 successively light up to indicate the end run down the field 12, including a zig-zag maneuver around defenders D3 and D4, until the ball light merges with the defender D5 at point R19. This point R19 is the tackle point of the play, with a resulting gain of twenty yards. This new position, at the thirty-yard line, becomes the line of scrimmage for the next play. As mentioned previously, the play outcome including yards gained or lost is predetermined by the microprocessor 32 prior to the beginning of play execution. Note that FIG. 11*a* only shows the defenders at their final position. These positions are not necessarily the original positions of each of the players at the beginning of the play execution. Usually, the play execution includes all five defenders converging on the moving ball as the point of tackle approaches.

If a loss had occurred on the play, a defender D1 for example would have "collided" with the moving ball at some point R1-R5 behind the line of scrimmage. If a fumble occurs, the point of tackle R19 would be where the fumble would occur, thereby giving the ball over to the red team at this point.

Figure 11B:
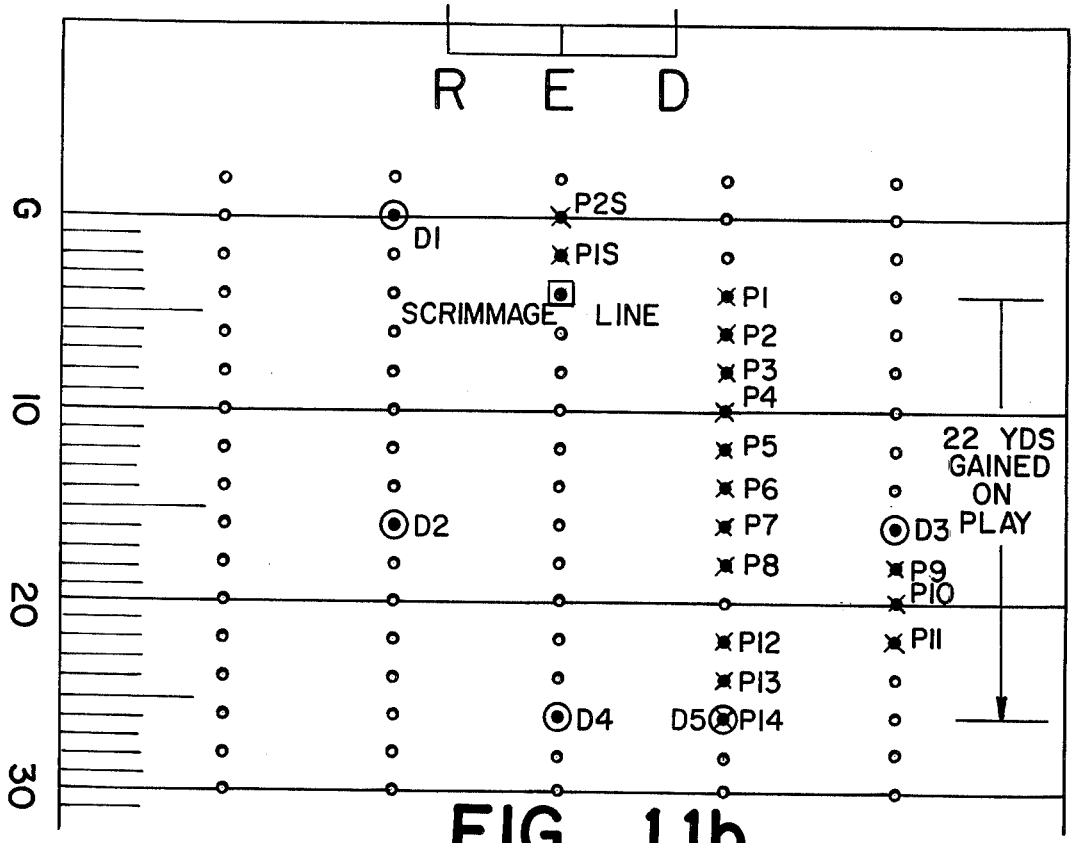

FIG. 11*b* illustrates a typical pass play on the playing field 12, with the blue team again having possession of the ball. In this example, the ball is initially on the four-yard line and the play chosen is a down and out pass.

Assuming first that the passer was not sacked, nor the pass intercepted, nor that the pass was thrown incomplete, the play begins by the ball moving to where P1 is the lit LED. The ball is thrown in a down and out direction down the field 12, as illustrated by the successive going on of the LED's P2 through P9 at a rate that is faster than if the ball was being run on the ground. At P9 the ball is caught so that the ball movement pauses with P9 momentarily remaining lit. Then, the "run on" begins by the pass receiver from point P9 to P14 where the receiver is tackled by the defender D5, i.e., where the ball light collides with the LED light indicating this defender's position. The gain on the play at P14 is twenty-two yards, with this twenty-six yard line position becoming the new scrimmage line for the next chosen play.

Had the passer been sacked, defender D1 would have converged on the ball light back at P2S before the pass was thrown, thus stopping a play there with a tackle for a loss on the play. If the ball was thrown incomplete, the pass pattern would still be shown, i.e., LED's P2-P9 would still light successively, but the ball light thereafter returns to the original line of scrimmage after P9 is lit to end the play. If the ball is to be intercepted, point P9 would have been lit at the beginning of the pass play and the ball would have converged to this lit LED. The ball would then go over to the defensive team at that spot. In the present embodiment, no runback is allowed for any intercepted passes. Again, the defenders D1-D5 depicted in FIG. 11*b* are shown in positions that are not necessarily their original positions. Usually, play execution includes all five defenders converging on the moving ball. However, if a run or a pass is a long one, the play execution routine may show the ball zig-zagging around the defenders, to ultimately pass them up thereby enabling the ball to go all the way down the field for a touchdown.

When a field goal or extra point is attempted and it is successful, the middle end zone LED, marked F1 in Fig. 11*a*, will light up at the end of the path of the kick (which is not shown). If the kick is wide, one of the other two end zone LED's F2 or F3 would light up. Also, the respective "GOOD" or "NO GOOD" message indicators on the scoreboard 14 would also light up (see FIG. 4).

Other embodiments wherein the present invention is applicable includes a structure using a T.V. screen for the playing field 12 instead of an LED array 20, or a structure having more or less offensive and defensive players on the field, or wherein the number of play choices available are greater or less, etc. All of these alternatives would require only that relatively simple changes be made in the processor controller, perhaps including a change in the size of the ROM 34, and modification of the output control circuitry for any modified display. Thus, it is believed that persons skilled in the art will make various modifications including those suggested above without departing from this invention, as claimed below.

What is claimed is:

1. An electronic game apparatus comprising:

a simulated playing field including automatically controllable indicia means for displaying game ball position and play execution movement;

scoreboard display means including automatically controllable indicia means for displaying game data;

first means for manually inputting a selected one of a plurality of play choices by a player presently on offense;

second means for manually inputting a selected one of a plurality of play choices by a player presently on defense;

game controller means including microprocessor means, random access memory means, and read-only memory means, wherein one portion of said read-only memory means includes probability table means comprising a plurality of stored electrical states arranged such that said states represent odds of success for different parameters involved in each play choice, and wherein a second portion of said read-only memory means includes a processor controller comprising a plurality of stored electrical states, said game controller means operating to detect input play choices and operating to generate a random number in response thereto, said processor controller operatively enabling said microprocessor means in conjunction with said random access memory means to automatically selectively access a plurality of said states in said probability table means based on the play choice of the offensive player, the play choice of the defensive player, and based on said random number, the accessed states of said probability table means constituting a specific play outcome;

clock generator means, said clock generator means acting in conjunction with said microprocessor means and said random access memory means of said game controller means to use said play outcome to automatically generate a play execution;

means for enabling said game controller to automatically control said playing field indicia means such that in real time said generated play execution is displayed, wherein the game ball is displayed as moving from an initial position on said playing field to a position corresponding to that determined by said play outcome; and means for automatically updating said scoreboard display means under the control of said game controller means such that the current status of the game is continuously maintained thereon.

2. The game apparatus of claim 1 wherein said game controller means and said clock generator means further cooperate to enable said game controller to keep track of game time remaining, to continuously display said game time remaining on said scoreborad, to allow a plurality of successive play outcomes and play executions resulting from a plurality of successive offensive and defensive play choices to occur, and to terminate the game play when said game time remaining indicates that the game time has run out.

3. The game apparatus of claim 2 wherein said game controller means and said clock generator means further cooperate to enable said game controller to keep track of a set length of time after a previous play execution, and for penalizing the playing field position of the player who takes longer than said set length of time to make a play choice.

4. The game apparatus of claim 1, wherein said simulated playing field indicia means comprises an array of lights wherein each light is individually and selectively controllable.

5. The game apparatus of claim 4, wherin said means for enabling said game controller means to automatically control said playing field indicia means comprises a plurality of select latches, a plurality of decoders, and means for coupling the outputs of said decoders to said lights comprising a plurality of array signal lines, wherein said game controller means inputs data to said latches, said data corresponding to a desired light, said latches coupling said data to said decoders, said decoders decoding said data into said plurality of array signal lines arranged such that said signal lines cooperatively enable thereby the energizing of a single one of the lights in said light array.

6. The game apparatus of claim 5 wherein said array of lights is organized into a plurality of rows of lights with a plurality of lights in each row, and wherein said decoders and array signal lines are organized such that a first portion of said latches couples data to row decoders for selectively energizing one of said rows, a second portion of said latches couples data to block decoders for selectively energizing one block of lights within said selected row, and a third portion of said latches couples data to third decoders for selectively energizing a single one of a plurality of lights in said selected block of said selected row.

7. The game apparatus of claim 1 wherein the first and second means for manually inputting a selected one of a plurality of player choices comprises respective separate keyboards, one for each player, said keyboards each including a plurality of keyboard switches, and comprises an input gate select decode wherein said select decode is controllable by said game controller means such that switch status data from one or the other of said keyboards is periodically selectively coupled to said game controller means.

8. The game apparatus of claim 7 wherein said game controller means further comprises input multiplexer means for selectively gating and coupling data to said microprocessor means, said data comprising either switch status data or data from the random access memory means, or from said read-only memory means.

9. The game apparatus of claim 8 wherein said microprocessor means comprises a microprocessor and state decoder means, said microprocessor comprising a miniaturized electronic circuit including an input/output register, an arithmetic/logic unit, an accumulator register, a plurality of temporary storage registers, a program counter register, an instruction and decode control unit, and means for coupling signals from one register or unit to another, to enable the implementation of various instructions as decoded by the instruction decode and control unit, said microprocessor further comprising a plurality of data lines connected to the input/output register to allow said microprocessor to receive data from said input multiplexer means, or to output data and control signals to external units and a plurality of microprocessor control lines to further enable control of external units, said instruction and decode control unit instructions originating from said processor controller.

10. The game apparatus of claim 9 wherein said state decoder means comprises means for generating a plurality of game controller lines from said microprocessor control line for operatively controlling said input gate select decode, said random access memory means, said input multiplexer means, and said playing field indicia means in conjunction with said processor controller.

11. The game apparatus of claim 10, wherein said microprocessor means in conjunction with said processor controller generates a plurality of random numbers, said numbers being generated from one of said temporary storage registers in said microprocessor means, wherein said register is continuously operatively incremented by one count by said microprocessor means under the control of said processor controller.

12. The game apparatus of claim 1 wherein said game controller further controls said playing field indicia means such that a plurality of lights represeting defenders are alternately energized during display of play execution and such that said lights converge into said displayed game ball as the playing field position corresponding to that determined by said play outcome is reached, to represent thereby the stopping of said game ball by said defenders, said plurality of lights being alternately energized by said game controller at a rate that is fast enough so that the lights appear to all be simultaneously on.

13. A game apparatus for simulating the strategy of an athletic contest comprising:

offensive play selection means;

defensive play selection means;

a simulated playing field including automatically controlled indicia means for displaying game execution;

microprocessor means including random number generator means;

random access memory means operatively associated with said offensive play selection means and said defensive play selection means and with said microprocessor means, said random access memory means including means for storing an offensive play selected by said offensive play selection means and means for storing a defensive play selected by said defensive play selection means;

read-only memory means operatively connected to said microprocessor and comprising a plurality of permanently stored electrical states, said stored states operating in conjunction with said microprocessor means and said random access memory means to create a play result that mathematically approximates the probability of success of the play in the athletic contest being simulated based on the play choice of the offensive player, the play choice of the defensive player, and the output of said random number generator;

clock means operatively connected to said microprocessor means; and means for coupling the play result to said simulated playing field, under the control of said microprocessor and read-only memory means in conjunction with said clock means, such that said play result is executed thereon in a time frame approximating that of the athletic contest being simulated.

14. A method for electronically simulating the strategy of an athletic contest from electrical signals selected by competing players representing chosen offensive and counteracting defensive plays of said athletic contest comprising the steps of:

a. electronically detecting said signals representing said chosen offensive play and said chosen counteracting defensive play;

b. electronically generating one or more random numbers;

c. operatively accessing automatically a plurality of electronically stored probability tables as a function of the detected plays chosen and random numbers generated, for obtaining data therefrom;

d. electronically processing said obtained data to generate a play outcome; and e. thereafter electronically displaying automatically and in real time on a simulated playing field said play outcome, including the location and movement of opposing players.

15. The method of claim 14 wherein the step of electronically displaying said play outcome includes the step of:

i. simulating the position of opposing players on said simulated playing field by automatically individually turning on indicators on said simulated playing field;

ii. simulating player movement on said playing field by automatically individually turning on successive indicators, in a two-dimensional array of indicators on said playing field, along the path of the play defined by the play outcome; and iii. retaining and storing the final indicators position such that successive play outcomes begin at the point on said simulated playing field where the prior play outcome ended.

16. The method of claim 14 wherein step (c) further comprises the steps of:

i. selectively accessing one of a plurality of success criteria probability tables based on whether said offensive and said defensive play choices are identical, in the same category, or in different categories wherein the accuracy of the choice affects the probability of success;

ii. using one of said random numbers and said chosen offensive play to access a specific location in each of the probability tables in said selected set of success criteria probability tables for obtaining thereby specific success data; and iii. using another said random number and said chosen offensive play to access a specific location in a probability table to obtain thereby data corresponding to one of a plurality of possible ranges of field position change experienced in said athletic contest being simulated.

17. The method of claim 16 wherein step (d) comprises the steps of:

i. using a random number to arithmetically generate specific field position values from field position ranges generated by the accessing of specific locations in said probability tables; and ii. adding said specific field position values to the present field position value corresponding to the point on the playing field wherein the previous play outcome ended.

18. The method of claim 14 further comprising the steps of:

f. electronically generating and displaying time remaining in said simulated athletic contest;

g. automatically terminating said simulated athletic contest operation when time remaining runs out, said termination occurring independently of the number of play outcomes displayed;

h. automatically updating the data on the scoreboard after every play outcome has been displayed on said playing field;

i. automatically subtracting from the offensive field position a set value as a penalty for delay of game if an offensive play is not detected within a specific set length of time after the previous play outcome has been displayed; and j. automatically allowing only probability tables to be accessed that favor the offensive play during the obtaining of data for the next play outcome, if a defensive play is not detected within a specific set length of time after the previous play outcome has been displayed, as a delay of game penalty against the defense.

19. American football game apparatus for competitive use comprising:

a. first electrical input means enabling a first player to choose a desired one of a plurality of different electrical states representative of a play choice of said first input means;

b. second electrical input means enabling a second player to choose a desired one of a plurality of different electrical states representative of a play choice of said second input means;

c. visual output means including electrically controllable indicia means;

d. clock means producing electrical clock signals;

e. game controller means including a microprocessor, a read-only memory means and a random access memory means interconnected with each other and with said clock means, first electrical input means and second electrical input means, said read-only memory means providing a plurality of electrical states comprising preestablished probability tables in addition to a plurality of electrical states comprising a control program of play success parameters for said microprocessor whereby a random number is generated and applied to said read-only memory means together with one of a plurality of electrical signals each representative of a different relationship between said chosen electrical states of said first and second electrical input means to select a plurality of electrical states of said probability tables for storage in said random access memory means; and f. means interconnecting said random access memory means with said visual output means under the control of said game controller means and said clock means whereby said selected electrical states of said probability tables stored in said random access memory means as modified by said game controller is applied to said electrically controllable indicia means of said visual output means to visually present the play of said game apparatus in real time.

20. Game apparatus as claimed in claim 19 wherein said plurality of probability tables are each selected by different ones of said plurality of electrical signals each representative of a different relationship between said chosen electrical states of said first and second electrical input means.

21. Game apparatus as claimed in claim 20 wherein said plurality of electrical states of said read-only memory means comprising said control program controls said microprocessor to generate a plurality of random numbers each of which is applied to a different one of said plurality of probability tables provided by electrical states of said read-only memory whereby a plurality of electrical states are provided for storage in said random access memory means.

22. Game apparatus as claimed in claim 19 wherein said visual output means comprises a first portion simulating a playing field and a second portion providing a score board.

23. Game apparatus as claimed in claim 19 wherein said game controller means is adapted to utilize said electrical clock signals of said clock means under the control of said control program provided by said plurality of electrical states of said read-only memory to limit various parameters of the play of said game apparatus in real time.

24. Game apparatus as claimed in claim 23 wherein said game controller means is adapted to automatically execute certain portions of the play of said game apparatus under the control of said clock signals of said clock means and said control program provided by said plurality of electrical states of said read-only memory without input from said first and second input means.

* * * * *